US008983831B2

(12) United States Patent
Yamanashi et al.

(10) Patent No.: US 8,983,831 B2
(45) Date of Patent: Mar. 17, 2015

(54) ENCODER, DECODER, AND METHOD THEREFOR

(75) Inventors: Tomofumi Yamanashi, Kanagawa (JP); Masahiro Oshikiri, Kanagawa (JP); Hiroyuki Ehara, Kanagawa (JP)

(73) Assignee: Panasonic Intellectual Property Corporation Of America, Torrance, CA (US)

( * ) Notice: Subject to any disclaimer, the term of this patent is extended or adjusted under 35 U.S.C. 154(b) by 529 days.

(21) Appl. No.: 13/203,122

(22) PCT Filed: Feb. 25, 2010

(86) PCT No.: PCT/JP2010/001289
§ 371 (c)(1),
(2), (4) Date: Aug. 24, 2011

(87) PCT Pub. No.: WO2010/098112
PCT Pub. Date: Sep. 2, 2010

(65) Prior Publication Data

US 2011/0307248 A1 Dec. 15, 2011

(30) Foreign Application Priority Data

Feb. 26, 2009 (JP) ..... 2009-044676
Apr. 2, 2009 (JP) ..... 2009-089656
Jan. 7, 2010 (JP) ..... 2010-001654

(51) Int. Cl.
*G10L 19/02* (2013.01)
*G10L 21/038* (2013.01)

(52) U.S. Cl.
CPC ..... *G10L 19/0204* (2013.01); *G10L 21/038* (2013.01)
USPC ..... 704/219; 704/205

(58) Field of Classification Search
CPC ..... H05K 999/99; H04B 1/667; H04B 1/66; G10L 19/02; G10L 21/038
USPC ..... 704/205, 219–222
See application file for complete search history.

(56) References Cited

U.S. PATENT DOCUMENTS 5,227,990 A * 7/1993 Vaupel et al. ..... 708/303
6,708,145 B1 * 3/2004 Liljeryd et al. ..... 704/200.1
(Continued)

FOREIGN PATENT DOCUMENTS

EP 1 926 083 5/2008
JP 2004/004530 1/2004
(Continued)

OTHER PUBLICATIONS

International Search Report dated Apr. 20, 2010.
M. Tammi, et al., "Scalable Superwideband Extension for Wideband Coding," IEEE ICASSP, 2009, pp. 161-164.
Supplementary European Search Report dated Sep. 4, 2013.

*Primary Examiner* — Abul Azad
(74) *Attorney, Agent, or Firm* — Dickinson Wright PLLC

(57) ABSTRACT

Provided is an encoder which can effectively encode/decode spectrum data of a broad frequency signal in a high frequency range, can dramatically reduce the number of the arithmetic operations to be performed, and can improve the quality of the decoded signal. The encoder comprises a first layer coding unit (202) which encodes an input signal in a low frequency range below a predetermined frequency to generate first coded information, a first layer decoding unit (203) which decodes the first coded information to generate a decoded signal, and a second layer coding unit (206) which splits the input signal in a high frequency range above a predetermined frequency, into a plurality of sub-bands, presumes the respective sub-hands from the input signal or decoded signal, partially selects a spectrum component within each sub-band, and calculates an amplitude adjustment parameter used to adjust the amplitude of the selected spectrum component to thereby generate second coding information.

13 Claims, 15 Drawing Sheets

(56) References Cited

U.S. PATENT DOCUMENTS

| | | | | |
|---|---|---|---|---|
| 6,807,524 | B1 * | 10/2004 | Bessette et al. | 704/200.1 |
| 2003/0142746 | A1 | 7/2003 | Tanaka | |
| 2005/0096917 | A1 * | 5/2005 | Kjorling et al. | 704/500 |
| 2006/0031075 | A1 | 2/2006 | Oh | |
| 2008/0027733 | A1 * | 1/2008 | Oshikiri et al. | 704/500 |
| 2008/0052066 | A1 * | 2/2008 | Oshikiri et al. | 704/221 |

FOREIGN PATENT DOCUMENTS

| | | |
|---|---|---|
| JP | 2006/048043 | 2/2006 |
| WO | 2006/049204 | 5/2006 |
| WO | 2007/052088 | 5/2007 |

* cited by examiner

ENCODER, DECODER, AND METHOD THEREFOR

TECHNICAL FIELD

The present invention relates to an encoding apparatus, a decoding apparatus, and a method therefor that are used for a communication system which transmits a signal by encoding the signal.

BACKGROUND ART

When speech or sound signals are transmitted by a packet communication system, a mobile communication system, or the like as represented by Internet communications, compressing and encoding techniques are often used to increase transmission efficiency of the speech or sound signals. Further, in recent years, while encoding speech or sound signals at simply a low bit rate, there is an increasing demand for a technique of encoding speech or sound signals of a broader band.

To meet this need, various techniques have been developed to encode broadband speech or sound signals without substantially increasing the amount of information after encoding. For example, according to a technique disclosed in Patent Literature 1, an encoding apparatus calculates a parameter to generate a spectrum of a high frequency part out of spectrum data obtained by converting an input acoustic signal for a constant time period, and outputs this parameter by matching this with encoded information of a low frequency part. Specifically, the encoding apparatus divides the spectrum data of a high frequency part of a frequency into plurality of sub-bands, and calculates a parameter that specifies a spectrum of a low frequency part that is most similar to the spectrum of each sub-band. Next, the encoding apparatus adjusts the most similar spectrum of a low frequency part by using two kinds of scaling factors such that a peak amplitude, or energy of a sub-band (hereinafter, "sub-band energy") and a shape in a high-frequency spectrum to be generated becomes similar to a peak amplitude, sub-band energy, and a shape of a spectrum of a high frequency part of an input signal as a target.

CITATION LIST

Patent Literature

PTL 1
WO Publication No. 2007/052088

SUMMARY OF INVENTION

Technical Problem

However, according to the above-described Patent Literature 1, in combining a high-frequency spectrum, the encoding apparatus performs a logarithmic transform to all samples (MDCT coefficients) of spectrum data of an input signal and combined high-frequency spectrum data. Then, the encoding apparatus calculates a parameter such that respective sub-band energy and shapes becomes similar to a peak amplitude, sub-band energy, and a shape of a high-frequency spectrum of the input signal as the target. Therefore, there is a problem that the volume of arithmetic operations in the encoding apparatus is very large. Further, the encoding apparatus applies a calculated parameter to all samples within the sub-bands, and does not take into account sizes of amplitudes of individual samples. Consequently, the volume of arithmetic operations in the encoding apparatus when generating a high-frequency spectrum by using the calculated parameter also becomes very large. Further, quality of decoded speech to be generated is insufficient, and there is a possibility that abnormal sound is generated depending on the case.

It is therefore an object of the present invention to provide an encoding apparatus, a decoding apparatus and a method therefor capable of efficiently encoding spectrum data of a high frequency part and improving quality of a decoded signal based on spectrum data of a low frequency part of a broadband signal.

Solution to Problem

The encoding apparatus of the present invention is configured to include: first encoding means for generating first encoded information by encoding a lower frequency part equal to or lower than a predetermined frequency of an input signal; decoding means for generating a decoded signal by decoding the first encoded information; and second encoding means for generating second encoded information by dividing a high frequency part of the input signal higher than the predetermined frequency into a plurality of sub-bands, estimating the a plurality of sub-bands respectively from the input signal or the decoded signal, partially selecting a spectrum component within each of the sub-bands, and calculating an amplitude adjustment parameter for adjusting an amplitude for the selected spectrum component.

The decoding apparatus of the present invention is configured to include: receiving means for receiving first encoded information obtained by encoding a lower frequency part of an input signal equal to or lower than a predetermined frequency generated by the encoding apparatus, and second encoded information generated by dividing a high frequency part of the input signal higher than the predetermined frequency into a plurality of sub-bands, estimating the a plurality of sub-bands respectively from the input signal or from a first decoded signal obtained by decoding the first encoded information, partially selecting a spectrum component within each of the sub-bands, and calculating an amplitude adjustment parameter for adjusting an amplitude for the selected spectrum component; first decoding means for generating a second decoded signal by decoding the first encoded information; and second decoding means for generating a third decoded signal by estimating a high frequency part of the input signal from the second decoded signal.

The encoding method of the present invention includes: a step of generating first encoded information by encoding a lower frequency part of an input signal equal to or lower than a predetermined frequency; a step of generating a decoded signal by decoding the first encoded information; and a step of generating second encoded information by dividing a high frequency part of the input signal higher than the predetermined frequency into a plurality of sub-bands, estimating the a plurality of sub-hands respectively from the input signal or the decoded signal, partially selecting a spectrum component within each of the sub-bands, and calculating an amplitude adjustment parameter for adjusting an amplitude for the selected spectrum component.

The encoding method of the present invention includes: a step of receiving first encoded information obtained by encoding a lower frequency part of an input signal lower than a predetermined frequency generated by the encoding apparatus, and second encoded information generated by dividing a high frequency part of the input signal higher than the predetermined frequency into a plurality of sub-bands, estimating the a plurality of sub-bands respectively from the input signal or from a first decoded signal obtained by decoding the first encoded information, partially selecting a spectrum component within each of the sub-bands, and calculating an amplitude adjustment parameter for adjusting an amplitude for the selected spectrum component; a step of generating a second decoded signal by decoding the first encoded information; and a step of generating a third decoded signal by estimating a high frequency part of the input signal from the second decoded signal.

Advantageous Effects of Invention

According to the present invention, spectrum data of a high frequency part of a broadband signal can be efficiently encoded/decoded, the volume of arithmetic operations can be substantially reduced, and quality of a decoded signal can be also improved.

DESCRIPTION OF EMBODIMENTS

A main characteristic of the present invention is that the encoding apparatus calculates an adjustment parameter of sub-band energy and a shape of a sample group that is extracted based on a position of a sample of a maximum amplitude within a sub-band, when the encoding apparatus generates spectrum data of a high frequency part of a signal to be encoded based on spectrum data of a low frequency part. Another main characteristic is that the decoding apparatus applies the calculated parameter to the sample group that is extracted based on the position of the sample of a maximum amplitude within the sub-band. Based on these characteristics of the present invention, spectrum data of a high frequency part of a broadband signal can be efficiently encoded/decoded, the volume of arithmetic operations can be substantially reduced, and quality of a decoded signal can be also improved.

Embodiments of the present invention are explained in detail below with reference to drawings. A speech encoding apparatus and a speech decoding apparatus are explained as an example of the encoding apparatus and the decoding apparatus according to the present invention.

Embodiment 1

Figure 1:
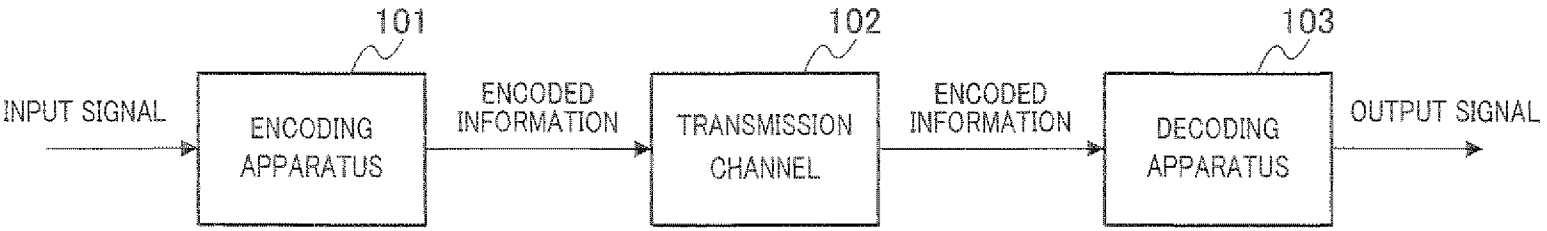
FIG. 1 is a block diagram showing a configuration of a communication system that has an encoding apparatus and a decoding apparatus according to Embodiment 1 of the present invention.

FIG. 1 is a block diagram showing a configuration of a communication system that has an encoding apparatus and a decoding apparatus according to Embodiment 1 of the present invention. In FIG. 1, communication system includes encoding apparatus 101 and decoding apparatus 103, and they can communicate with each other via transmission channel 102. Both encoding apparatus 101 and decoding apparatus 103 are usually used by being mounted on a base station apparatus, a communication terminal device, or the like.

Encoding apparatus 101 divides an input signal into each N samples (N is a natural number), and encodes each frame by setting N samples as one frame. An input signal to be encoded is expressed as $x_n(n=0, \ldots, N-1)$. This n denotes an (n+1)-th order of a signal element of the input signal that is divided into each N samples. Encoding apparatus 101 transmits encoded input information (encoded information) to decoding apparatus 103 via transmission channel 102.

Decoding apparatus 103 receives encoded information transmitted from encoding apparatus 101 via transmission channel 102.

Figure 2:
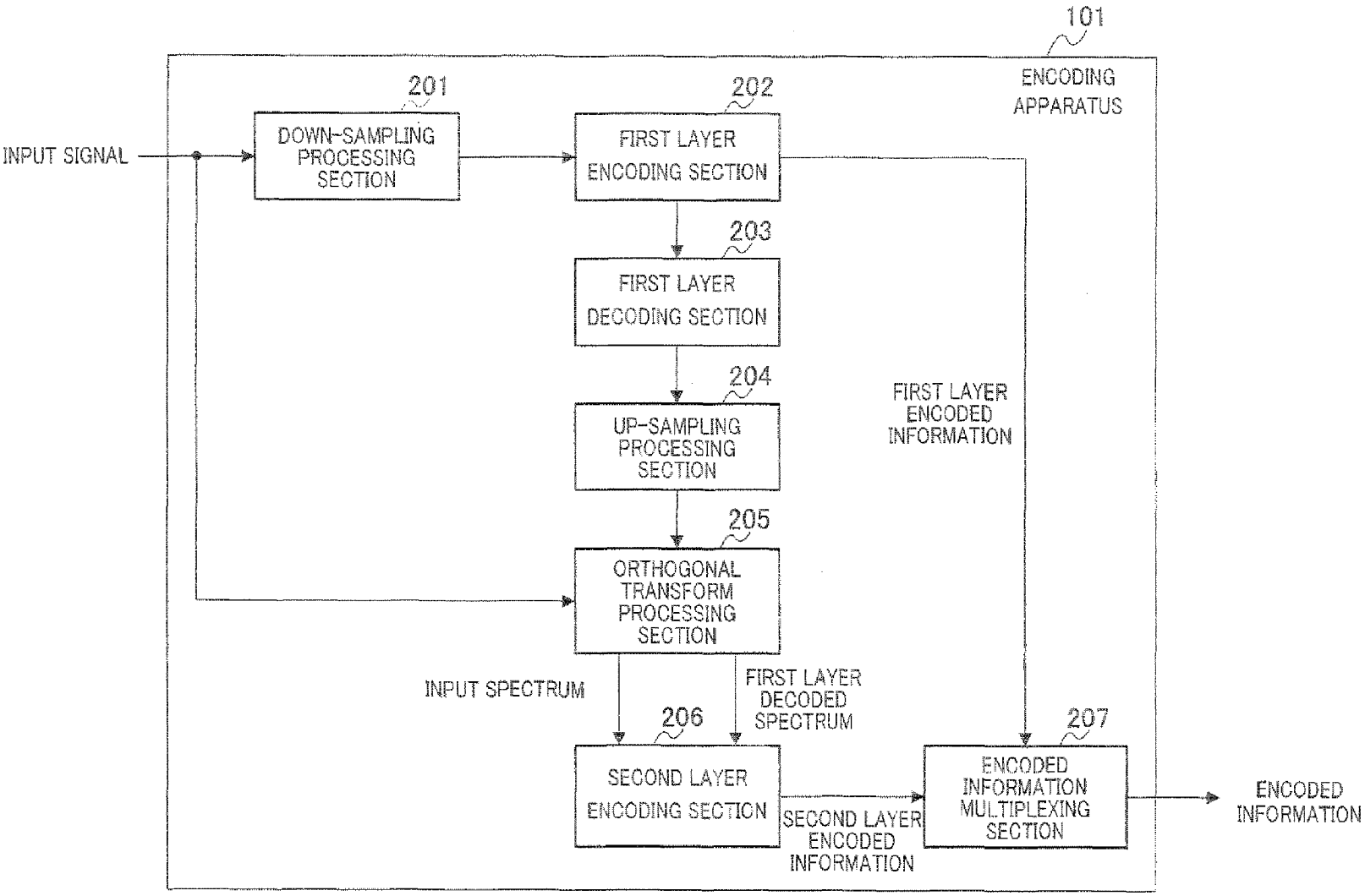
FIG. 2 is a block diagram showing a relevant configuration of the inside of the encoding apparatus shown in FIG. 1 according to Embodiment 1 of the present invention.

FIG. 2 is a block diagram showing a relevant configuration of the inside of encoding apparatus 101 shown in FIG. 1. When a sampling frequency of an input signal is $SR_1$, down-sampling processing section 201 down-samples the sampling frequency of the input signal from $SR_1$ to $SR_2$ ($SR_2<SR_1$), and outputs the input signal that is down-sampled, to first layer encoding section 202, as a down-sampled input signal. An operation is explained below by taking an example that $SR_2$ is a ½ sampling frequency of $SR_1$.

First layer encoding section 202 generates first layer encoded information by encoding the down-sampled input signal that is input from down-sampling processing section 201, by using a speech encoding method of a CELP (Code Excited Linear Prediction) system, for example. Specifically, first layer encoding section 202 generates the first layer encoded information, by encoding a lower frequency part of the input signal equal to or lower than a predetermined frequency. First layer encoding section 202 outputs the generated first layer encoded information to first layer decoding section 203 and encoded information multiplexing section 207.

First layer decoding section 203 generates a first layer decoded signal by decoding the first layer encoded information that is input from first layer encoding section 202, by using a speech decoding method of the CELP system, for example. First layer decoding section 203 outputs the generated first layer decoded signal to up-sampling processing section 204.

Up-sampling processing section 204 up-samples from $SR_2$ to $SR_1$ a sampling frequency of the first layer decoded signal that is input from first layer decoding section 203, and outputs the first layer decoded signal that is up-sampled, to orthogonal transform processing section 205, as an up-sampled first layer decoded signal.

Orthogonal transform processing section 205 has buffers $buf_1n$ and $buf_2n$ (n=0, . . . , N−1) in the inside, and performs modified discrete cosine transformation (MDCT) to the input signal $x_n$, and an up-sampled first layer decoded signal $y_n$, that is input from up-sampling processing section 204.

Regarding an orthogonal transform process by orthogonal transform processing section 205, a calculation step and a data output to an internal buffer are explained below.

First, orthogonal transform processing section 205 initializes the buffers $buf1_n$ and $buf2_n$ by setting "0" as an initial value respectively, by following equations 1 and 2.

Equation 1

$$buf1_n=0(n=0, \ldots, N-1) \quad [1]$$

Equation 2

$$buf2_n=0(n=0, \ldots, N-1) \quad [2]$$

Next, orthogonal transform processing section 205 performs MDCT to the input signal $x_n$ and the up-sampled first layer decoded signal $y_n$ by following equations 3 and 4, and obtains an MDCT coefficient of the input signal (hereinafter, "input spectrum") S2(*k*) and an MDCT coefficient of the up-sampled first layer decoded signal $y_r$, (hereinafter, "first layer decoded spectrum") S1(*k*).

Equation 3

$$S2(k) = \frac{2}{N}\sum_{n=0}^{2N-1} x'_n \cos\left[\frac{(2n+1+N)(2k+1)\pi}{4N}\right] \quad [3]$$

$$(k = 0, \ldots, N-1)$$

Equation 4

$$S1(k) = \frac{2}{N}\sum_{n=0}^{2N-1} y'_n \cos\left[\frac{(2n+1+N)(2k+1)\pi}{4N}\right] \quad [4]$$

$$(k = 0, \ldots, N-1)$$

In the above equations, k denotes an index of each sample in one frame. Orthogonal transform processing section 205 obtains $x'_n$ as a vector of combining the input signal $x_n$ and the buffer $buf1_n$ by following equation 5. Orthogonal transform processing section 205 also obtains $y_n'$ as a vector of combining the up-sampled first layer decoded signal $y_n$ and the buffer $buf2_n$ by following equation 6.

Equation 5

$$x'_n = \begin{cases} buf1_n & (n = 0, \ldots N-1) \\ x_{n-N} & (n = N, \ldots 2N-1) \end{cases} \quad [5]$$

Equation 6

$$y'_n = \begin{cases} buf2_n & (n = 0, \ldots N-1) \\ y_{n-N} & (n = N, \ldots 2N-1) \end{cases} \quad [6]$$

Next, orthogonal transform processing section 205 updates the buffers $buf1_n$ and $buf2_n$ by equations 7 and 8.

Equation 7

$$buf1_n=x_n(n=0, \ldots, N-1) \quad [7]$$

Equation 8

$$buf2_n=y_n(n=0, \ldots, N-1) \quad [8]$$

Orthogonal transform processing section 205 outputs the input spectrum S2(*k*) and the first layer decoded spectrum S1(*k*) to second layer encoding section 206.

The orthogonal transform process by orthogonal transform processing section 205 is explained above.

Second layer encoding section 206 generates second layer encoded information by using the input spectrum S2(*k*) and the first layer decoded spectrum S1(*k*) that are input from orthogonal transform processing section 205, and outputs the generated second layer encoded information to encoded information multiplexing section 207. A detail of second layer encoding section 206 is described later.

Encoded information multiplexing section 207 multiplexes the first layer encoded information that is input from first layer encoding section 202 and the second layer encoded information that is input from second layer encoding section 206, and outputs a multiplexed information source code to transmission channel 102 as encoded information by adding a transmission error code or the like to this information source code when necessary.

A relevant configuration of the inside of second layer encoding section 206 shown in FIG. 2 is explained next with reference to FIG. 3.

Second layer encoding section 206 includes band dividing section 260, filter state setting section 261, filtering section 262, search section 263, pitch coefficient setting section 264, gain encoding section 265, and multiplexing section 266, and each section performs the following operation.

Band dividing section 260 divides a high frequency part (FL≤k<FH) of the input spectrum S2(*k*) that is input from orthogonal transform processing section 205 higher than a predetermined frequency into P (where P is an integer larger than 1) sub-bands $SB_p$ (p=0, 1, . . . , P−1). Band dividing section 260 outputs a bandwidth $BW_p$ (p=0, 1, . . . , P−1) and a header index (that is, a start position of a sub-band) $BS_p$ (p=0, 1, . . . , P−1) ($FL \le BS_p < FH$) of each divided sub-band, as band division information, to filtering section 262, search section 263, and multiplexing section 266. Hereinafter, out of the input spectrum S2(*k*), a part corresponding to the sub-band $SB_p$ is described as a sub-band spectrum $S2_p(k)$ ($BS_p \le k < BS_p + BW_p$).

Filter state setting section 261 sets the first layer decoded spectrum S1(*k*) (0≤k<FL) that is input from orthogonal transform processing section 205 as a filter state to be used by filtering section 262. That is, the first layer decoded spectrum S1(*k*) is stored as an internal state (a filter state), in a band of $0 \le k < FL$ of the spectrum S(k) of an entire frequency band $0 \le k < FH$ in filtering section 262.

Filtering section 262 includes a pitch filter of multiple taps, filters the first layer decode spectrum based on a filter state that is set by filter state setting section 261, a pitch coefficient that is input from pitch coefficient setting section 264, and band division information that is input from band dividing section 260, and calculates an estimated value $S2_p'(k)$ ($BS_p \le k < BS_p + BW_p$) (p=0, 1, . . . , P−1) (hereinafter, "estimated spectrum $S2_p'$ of sub-band $SB_p$) of each sub-band $SB_p$ (p=0, 1, . . . , P−1). Filtering section 262 outputs the estimated spectrum $S2p'(k)$ of the sub-band $SB_p$ to search section 263. A detail of the filtering process of filtering section 262 is described later. It is assumed that the number of taps of multiple taps can be an arbitrary value (an integer) equal to or larger than 1.

Search section 263 calculates a degree of similarity between the estimated spectrum $S2_p'(k)$ of the sub-band $SB_p$ that is input from filtering section 262 and the spectrum $S2_p(k)$ of each sub-band in the high frequency part ($FL \le k < FH$) of the input spectrum $S2(k)$ that is input from orthogonal transform processing section 205, based on the band division information that is input from band dividing section 260. This degree of similarity is calculated by a correlation calculation, for example. Processes of filtering section 262, search section 263, and pitch coefficient setting section 264 constitute a search process of a closed loop for each sub-band. In each closed loop, search section 263 calculates a degree of similarity corresponding to each pitch coefficient by variously changing a pitch coefficient T that is input from pitch coefficient setting section 264 to filtering section 262. In a closed loop for each sub-band, search section 263 obtains an optimal pitch coefficient $T_p'$ (within a range of Tmin to Tmax) at which the degree of similarity becomes maximum in a closed loop corresponding to the sub-band $SB_p$, and outputs P optimal pitch coefficients to multiplexing section 266. A detail of a calculation method of a degree of similarity by search section 263 is described later.

Search section 263 calculates a part of the band (a band that is most similar to each spectrum of each sub-band) of the first layer decoded spectrum similar to each sub-band $SB_p$, by using each optimal pitch coefficient $T_p'$. Further, search section 263 outputs to gain encoding section 265 the estimated spectrum $S2_p'(k)$ corresponding to each optimal pitch coefficient $T_p'$ (p=0, 1, . . . , P−1), and an ideal gain $\alpha 1_p$, as an amplitude adjustment parameter that is used to calculate the optimal pitch coefficient $T_p'$ (p=0, 1, . . . , P−1) calculated following equation 9. In equation 9, M' denotes the number of samples to use to calculate a degree of similarity D, and this can be an arbitrary value equal to or smaller than a bandwidth of each sub-band. Needless to mention, M' can be a value of a sub-band width $BW_i$. A detail of the search process of the optimal pitch coefficient $T_p'$ (p=0, 1, . . . , P−1) by search section 263 is described later.

Equation 9

$$\alpha 1_p = \frac{\sum_{k=0}^{M'} S2(BS_p + k) \cdot S2'(BS_p + k)}{\sum_{k=0}^{M'} S2'(BS_p + k) \cdot S2'(BS_p + k)} \quad \left( \begin{array}{c} p = 0, \ldots, P-1 \\ 0 < M' \le BW_p \end{array} \right) \qquad [9]$$

Pitch coefficient setting section 264 sequentially outputs to filtering section 262 the pitch coefficient T by slightly changing it in a predetermined search range Tmin to Tmax together with filtering section 262 and search section 263 under the control of search section 263. Pitch coefficient setting section 264 can set the pitch coefficient T by slightly changing it in the predetermined search range Tmin to Tmax in the case of performing a search process of a closed loop corresponding to the first sub-band, and can set the pitch coefficient T by slightly changing it based on an optimal pitch coefficient obtained in a search process of a closed loop corresponding to the (m−1)-th sub-band in the case of performing a search process of a closed loop corresponding to the m-th (m=2, 3, . . . , P) sub-band at and after a second sub-band, for example.

Gain encoding section 265 calculates for each sub-band, a logarithmic gain as a parameter for adjusting an energy ratio in a nonlinear domain, based on the input spectrum $S2(k)$, and the estimated spectrum $S2_p'(k)$ (p=0, 1, . . . , P−1) and the deal gain $\alpha 1_p$ of each sub-band that are input from search section 263. Gain encoding section 265 quantizes the ideal gain and the logarithmic gain, and outputs the quantized ideal gain and the quantized logarithmic gain to multiplexing section 266.

Figure 4:
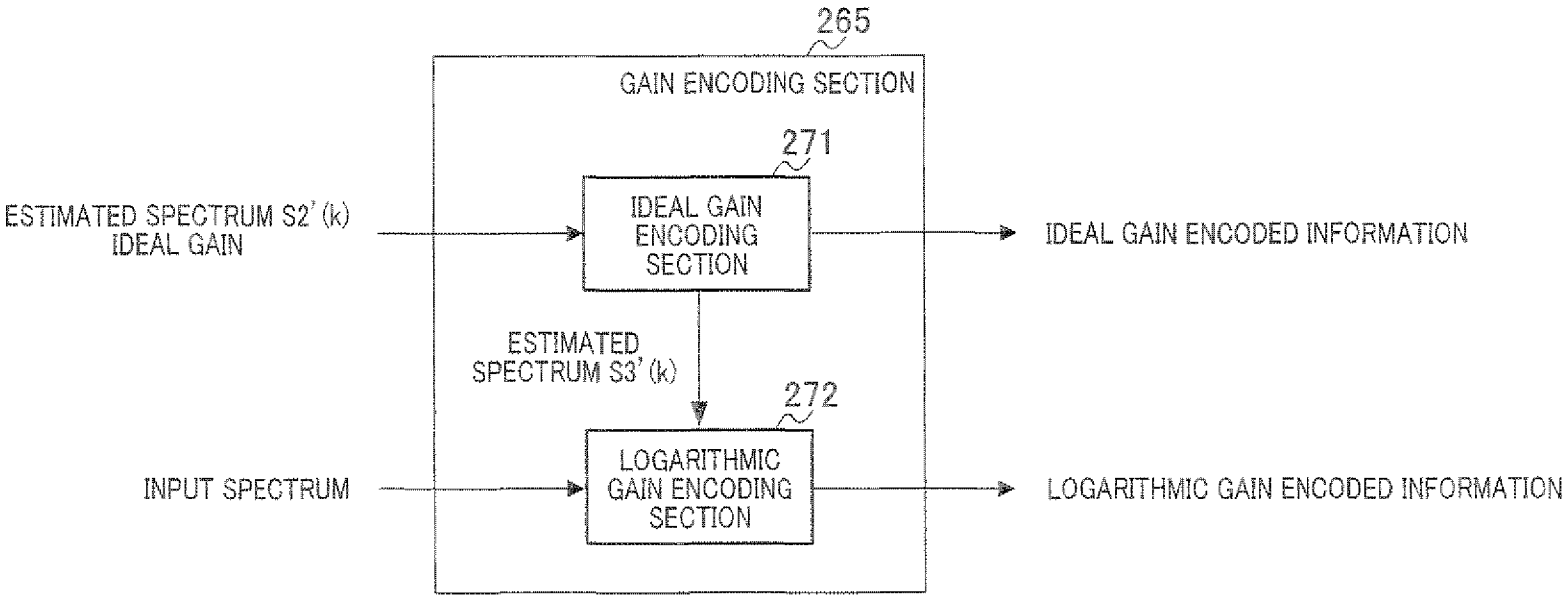
FIG. 4 is a block diagram showing a relevant configuration of a gain encoding section shown in FIG. 3 according to Embodiment 1 of the present invention.

FIG. 4 shows an internal configuration of gain encoding section 265. Gain encoding section 265 is mainly comprised of ideal gain encoding section 271 and logarithmic gain encoding section 272.

Ideal gain encoding section 271 configures the estimated spectrum S2' (k) of the high frequency part of the input spectrum by continuing in the frequency part the estimated spectrum $S2_p'(k)$ (p=0, 1, . . . , P−1) of each sub-band that is input from search section 263. Next, ideal gain encoding section 271 calculates an estimated spectrum S3'(k) by multiplying the ideal gain $\alpha 1_p$ of each sub-band input from search section 263 to the estimated spectrum S2' (k) following an equation 10. In the equation 10, $BL_p$ denotes a header index of each sub-band, and $BH_p$ denotes an end index of each sub-band. Ideal gain encoding section 271 outputs the calculated estimated spectrum S3'(k) to logarithmic gain encoding section 272. Ideal gain encoding section 271 quantizes the ideal gain $\alpha 1_p$, and outputs a quantized ideal gain $\alpha Q1_p$ to multiplexing section 266 as ideal gain encoded information.

Equation 10

$$S3'(k) = S2'(k) \cdot \alpha 1_p (BL_p \le k \le BH_p, \text{ for all } p) \qquad [10]$$

Logarithmic gain encoding section 272 calculates a logarithmic gain as a parameter (an amplitude adjustment parameter) for adjusting an energy ratio in the nonlinear domain for each sub-band between the high frequency part ($FL \le k < FH$) of the input spectrum $S2(k)$ that is input from orthogonal transform processing section 205 and the estimated spectrum S3'(k) that is input from ideal gain encoding section 271. Logarithmic gain encoding section 272 outputs the calculated logarithmic gain to multiplexing section 266 as logarithmic gain encoded information.

Figure 5:
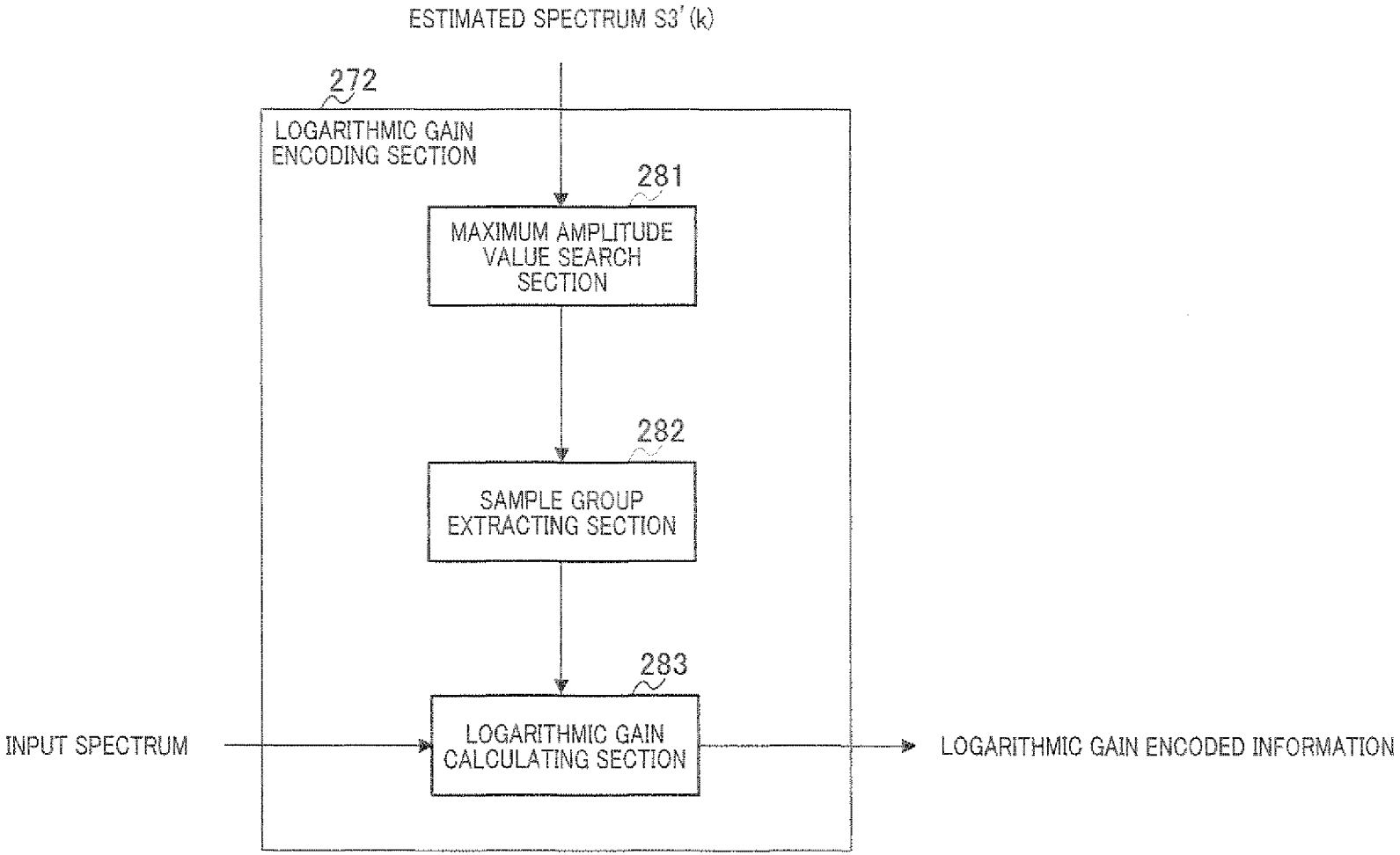
FIG. 5 is a block diagram showing a relevant configuration of a logarithmic gain encoding section shown in FIG. 4 according to Embodiment 1 of the present invention.

FIG. 5 shows an internal configuration of logarithmic gain encoding section 272. Logarithmic gain encoding section 272 is mainly comprised of maximum amplitude value search section 281, sample group extracting section 282, and logarithmic gain calculating section 283.

Maximum amplitude value search section 281 searches for, for each sub-band, a maximum amplitude value $MaxValue_p$, and an index of a sample (a spectrum component) of a sample of a maximum amplitude, that is, a maximum amplitude index $MaxIndex_p$, for the estimated spectrum S3'(k) that is input from ideal gain encoding section 271, as expressed by equation 11.

Equation 11

$$\begin{cases} MaxValue_p = \max(|S3'(k)|) \\ MaxIndex_p = k \text{ where } MaxValue_p = |S3'(k)| \end{cases} \quad [11]$$

$$(BL_p \le k \le BH_p, \text{ for all } p)$$

Maximum amplitude value search section 281 outputs the estimated spectrum S3'(k), the maximum amplitude value $MaxValue_p$, and the maximum amplitude index $MaxIndex_p$ to sample group extracting section 282.

Sample group extracting section 282 determines an extraction flag SelectFlag(k) for each sample corresponding to the calculated maximum amplitude index $MaxIndex_p$ for each sub-band, as expressed by equation 12. Sample group extracting section 282 outputs the estimated spectrum S3'(k), the maximum amplitude value $MaxValue_p$, and the extraction flag SelectFlag(k) to logarithmic gain calculating section 283. In the equation 12, $Near_p$ denotes a threshold value that becomes a basis of determining the extraction flag SelectFlag (k).

Equation 12

$$SelectFlag(k) = \begin{cases} 1 & \left( \begin{array}{c} If((MaxIndex_p - Near_p \le k \le \\ MaxIndex_p + Near_p) \\ \text{or} \\ (k = 0, 2, 4, 6, 8, \ldots \text{ (even)})) \end{array} \right) \\ 0 & \text{(otherwise)} \end{cases} \quad [12]$$

$$(BL_p \le k \le BH_p, \text{ for all } p)$$

That is, sample group extracting section 282 determines a value of the extraction flag SelectFlag(k) based on a standard that the value of the extraction flag SelectFlag(k) easily becomes 1 for a sample (a spectrum component) that is nearer a sample having the maximum amplitude value $MaxValue_p$ in each sub-band, as expressed by equation 12. That is, sample group extracting section 282 partially selects a sample based on a weight that enables a sample to be easily selected that is nearer a sample having the maximum amplitude value $MaxValue_p$ in each sub-band. Specifically, sample group extracting section 282 selects a sample of an index that indicates that a distance from the maximum amplitude value $MaxValue_p$ is within a range of $Near_p$, as expressed by equation 12. Further, sample group extracting section 282 sets a value of the extraction flag SelectFlag(k) to 1 for a sample of an even-numbered index even when the sample is not near a sample having a maximum amplitude value, as expressed by equation 12. Accordingly, even when a sample having a large amplitude is present in a band far from a sample having a maximum amplitude value, this sample or a sample having an amplitude near the amplitude of this sample can be extracted.

Logarithmic gain calculating section 283 calculates an energy ratio (a logarithmic gain) $\alpha 1_p$ in a logarithmic domain of the high frequency part (FL≤k<FH) of the estimated spectrum S3'(k) and the input spectrum S2(*k*), following equation 13, for a sample where the value of the extraction flag SelectFlag(k) that is input from sample group extracting section 282 is 1. In equation 13, M' denotes the number of samples to use to calculate a logarithmic gain, and this can be an arbitrary value equal to or smaller than a bandwidth of each sub-band. Needless to mention, M' can be a value of a sub-band width $BW_i$.

Equation 13

$$\alpha 2_p = \frac{\sum_{k=0}^{M'} (\log_{10}(|S2(BS_p + k)|) - MaxValue_p) \cdot (\log_{10}(|S3'(BS_p + k)|) - MaxValue_p)}{\sum_{k=0}^{M'} (\log_{10}(|S3'(BS_p + k)|) - MaxValue_p) \cdot (\log_{10}(|S3'(BS_p + k)|) - MaxValue_p)} \quad [13]$$

$$\begin{pmatrix} \text{if } SelectFlag(k) = 1 \\ p = 0, \ldots, P-1 \\ 0 < M' \le BW_p \end{pmatrix}$$

That is logarithmic gain calculating section 283 calculates the logarithmic gain $\alpha 2_p$ for only a sample that is partially selected by sample group extracting section 282. Logarithmic gain calculating section 283 quantizes the logarithmic gain $\alpha 2_p$, and outputs a quantized logarithmic gain $\alpha 2Q_p$ to multiplexing section 266 as logarithmic gain encoded information.

The process by gain encoding section 265 is explained above.

Multiplexing section 266 multiplexes, as second layer encoded information, the band division information that is input from band dividing section 260, the optimal pitch coefficient $T_p'$ to each sub-band $SB_p$ (p=0, 1, . . . , P−1) that is input from search section 263, the indexes (the ideal gain encoded information and the logarithmic gain encoded information) respectively corresponding to the ideal gains $\alpha 1Q_p$ and the logarithmic gain $\alpha 2Q_p$ that are input from gain encoding section 265, and outputs the second layer encoded information to encoded information multiplexing section 207. The indexes of $T_p'$, and $\alpha 1Q_p$ and $\alpha 2Q_p$ can be directly input to encoded information multiplexing section 207, and can be multiplexed as the first layer encoded information by encoded information multiplexing section 207.

Figure 3:
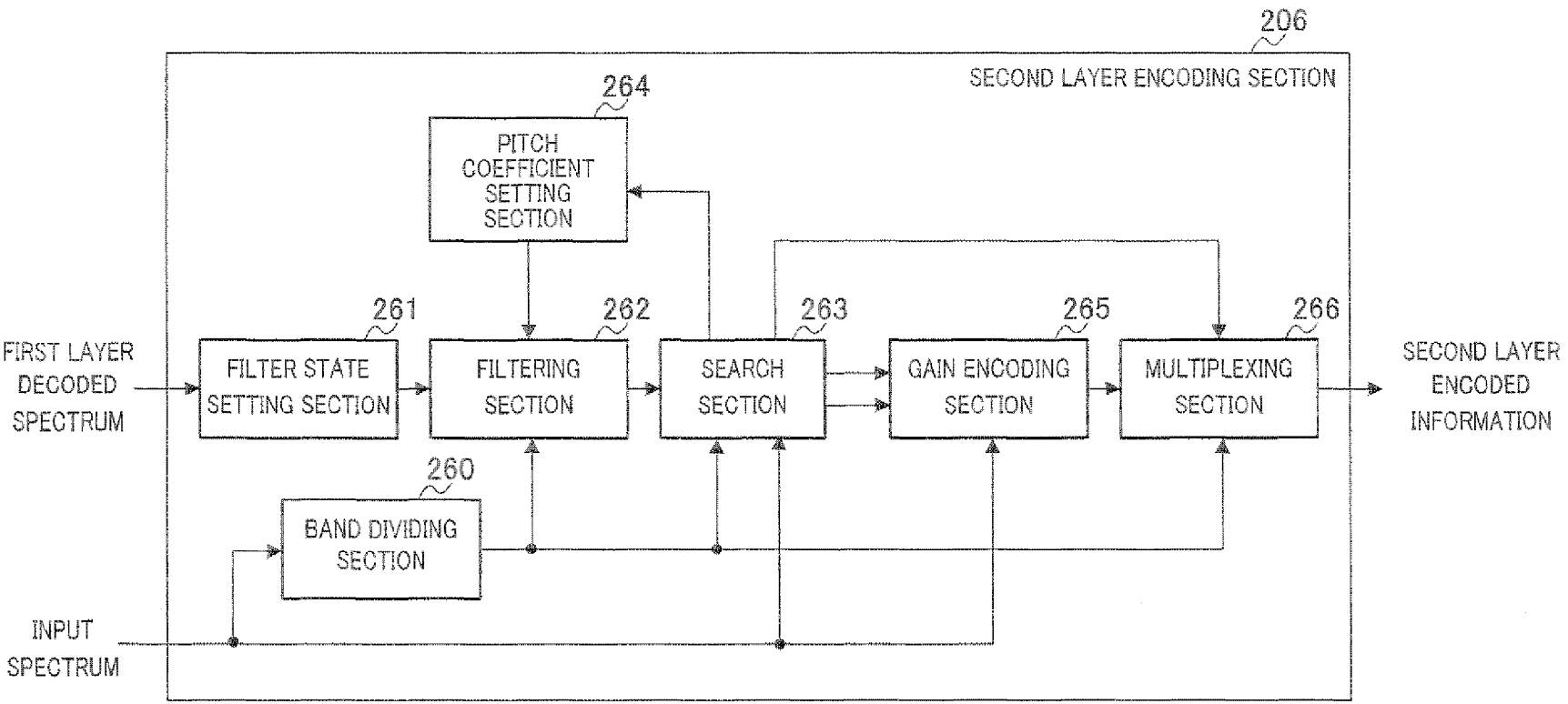
FIG. 3 is a block diagram showing a relevant configuration of the inside of a second layer encoding section shown in FIG. 2 according to Embodiment 1 of the present invention.
Figure 6:
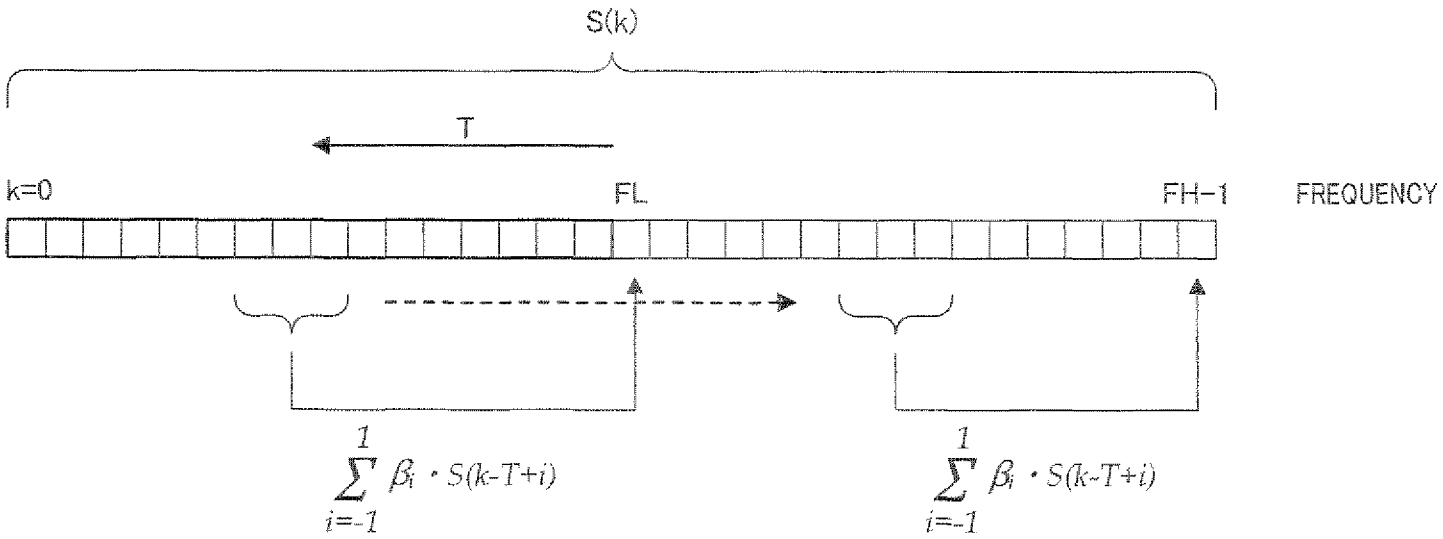
FIG. 6 is a diagram for explaining a detail of a filtering process in a filtering section according to Embodiment 1 of the present invention.

A detail of the filtering process by filtering section 262 shown in FIG. 3 is explained next with reference to FIG. 6.

Filtering section 262 generates an estimated spectrum in a band $BS_p \le k < BS_p + BW_p$ (p=0, 1, . . . , P−1) for the sub-band $SB_p$ (p=0, 1, . . . , P−1), by using the filter state that is input from filter state setting section 261, the pitch coefficient T that is input from pitch coefficient setting section 264, and the band division information that is input from band dividing section 260. A transmission function F(z) of a filter that is used by filtering section 262 is expressed by following equation 14.

A process of generating the estimated spectrum $S2_p'$(k) of the sub-band spectrum $S2_p$(k) is explained next by taking the sub-band $SB_p$ as an example.

Equation 14

$$F(z) = \frac{1}{1 - \sum_{i=-M}^{M} \beta_i z^{-T+i}} \quad [14]$$

In equation 14, T denotes a pitch coefficient that is given from pitch coefficient setting section 264, and $\beta_i$ denotes a filter coefficient that is stored beforehand in the inside. For example, when the number of taps is 3, a candidate of the filter coefficient is ($\beta_{-1}$, $\beta_0$, $\beta_1$)=(0.1, 0.8, 0.1). Further, a value of ($\beta_{-1}$, $\beta_0$, $\beta_1$)=(0.2, 0.6, 0.2), (0.3, 0.4, 0.3) is also suitable. A value of $(\beta_{-1}, \beta_0, \beta_1)=(0.0, 1.0, 0.0)$ is also suitable, and in this case, the value indicates that a part of a band of the first layer decoded spectrum of the band $0 \le k < FL$ is directly copied to the band of $BS_p \le k < BS_p + BW_p$ without changing a shape of the part of the band. In the following explanation, the value of $(\beta_{-1}, \beta_0, \beta_1)=(0.0, 1.0, 0.0)$ is assumed as an example. In equation 14, it is assumed that M=1. M denotes an index that is relevant to the number of taps.

The first layer decoded spectrum S1(*k*) is stored as an internal state (a filter state), in the band of $0 \le k < FL$ of the spectrum S(k) of the entire frequency band in filtering section 262.

The estimated spectrum $S2_p'(k)$ of the sub-band $SB_p$ is stored in the band of $BS_p \le k < BS_p + BW_p$ of S(k), by a filtering process in the following step. That is, as shown in FIG. 6, basically, a spectrum S(k−T) of a frequency that is lower than k by T is substituted in $S2_p'(k)$. However, to increase smoothness of the spectrum, actually, a spectrum that is obtained by adding to all i, a spectrum $\beta_i \cdot S(k-T+i)$ obtained by multiplying a near spectrum S(k−T+1) that is far by only i from the spectrum S(k) by a predetermined filter coefficient $\beta_i$, is substituted in $S2_p'(k)$. This process is expressed by following equation 15.

Equation 15

$$S2'_p(k) = \sum_{i=-1}^{1} \beta_i \cdot S2(k-T+i)^2 \quad [15]$$

The estimated spectrum $S2_p'(k)$ in $BS_p \le k < BS_p + BW_p$ is calculated by performing the above calculation, sequentially from $k=BS_p$ of a low frequency, by changing k in the range of $BS_p \le k < BS_p + BW_p$.

The above filtering process is performed by zero-clearing S(k) each time in the range of $BS_p \le k < BS_p + BW_p$, each time when the pitch coefficient T is given from pitch coefficient setting section 264. That is S(k) is calculated each time when the pitch coefficient T changes, and a result is output to search section 263.

Figure 7:
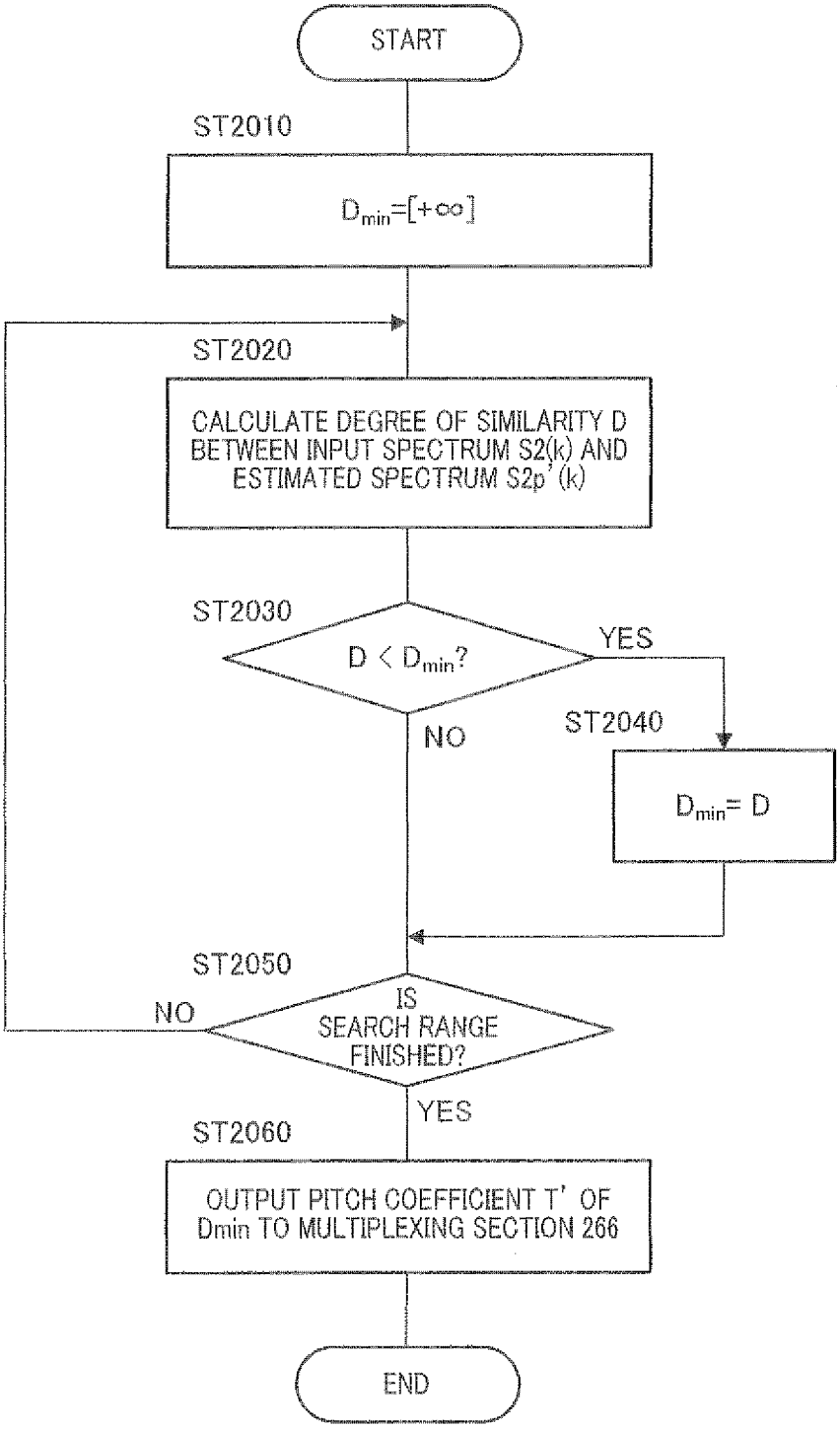
FIG. 7 is a flowchart showing a step of a process of searching for an optimal pitch coefficient $T_P'$ of a sub-band $SB_P$ in a search section according to Embodiment 1 of the present invention.

FIG. 7 is a flowchart showing a step of a process of searching for an optimal pitch coefficient $T_P'$ of a sub-band $SB_P$ in search section 263 shown in FIG. 3. Search section 263 searches for the optimal pitch coefficient $T_P'$ (p=0, 1, . . . , P−1) corresponding to each sub-band $SB_p$ (p=0, 1, . . . , P−1), by repeating the step shown in FIG. 7.

First, search section 263 initializes a minimum degree of similarity $D_{min}$, as a variable to store a minimum value of a degree of similarity, to "+∞" (ST2010). Next, search section 263 calculates a degree of similarity D between the high frequency part $(FL \le k < FH)$ of the input spectrum S2(*k*) in a certain pitch coefficient and the estimated spectrum $S2_p'(k)$, based on following equation 16 (ST2020).

Equation 16

$$D = \sum_{k=0}^{M'} S2(BS_p+k) \cdot S2(BS_p+k) \frac{\left( \sum_{k=0}^{M'} S2(BS_p+k) \cdot S2'(BS_p+k) \right)^2}{\sum_{k=0}^{M'} S2'(BS_p+k) \cdot S2'(BS_p+k)} \quad [16]$$

$$(0 < M' \le BW_p)$$

In equation 16, M' denotes the number of samples to calculate a degree of similarity D, and this value can be an arbitrary value equal to or smaller than a bandwidth of each sub-band. Needless to mention, M' can take a value of the sub-band width $BW_i$. In equation 16, $S2_p'(k)$ is not present, because $BS_p$ and S2'(k) are used to represent $S2_p'(k)$.

Search section 263 determines whether the calculated degree of similarity D is smaller than the minimum degree of similarity $D_{min}$ (ST2030). When the degree of similarity D calculated at ST2020 is smaller than the minimum degree of similarity $D_{min}$ (YES in ST2030), search section 263 substitutes the degree of similarity D to the minimum degree of similarity $D_{min}$ (ST2040). On the other hand, when the degree of similarity calculated at ST2020 is equal to or larger than the minimum degree of similarity $D_{min}$ (NO in ST2030), search section determines whether a process in the search range is finished. That is, search section 263 determines whether a degree of similarity has been calculated to all pitch coefficients within the search range following above equation 16 at ST2020 (ST2050). When the process is not finished in the search range (NO in ST2050), search section 263 returns the process to ST2020. Search section calculates a degree of similarity following equation 16 to pitch coefficients that are different from pitch coefficient to which a degree of freedom is calculated following equation 16 in the last step of ST2020. On the other hand, when the process is finished in the search range (YES in ST2050), search section 263 outputs the pitch coefficient T corresponding to the minimum degree of similarity $D_{min}$ to multiplexing section 266 as an optimal pitch coefficient $T_p'$ (ST2060).

Decoding apparatus 103 shown in FIG. 1 is explained next.

Figure 8:
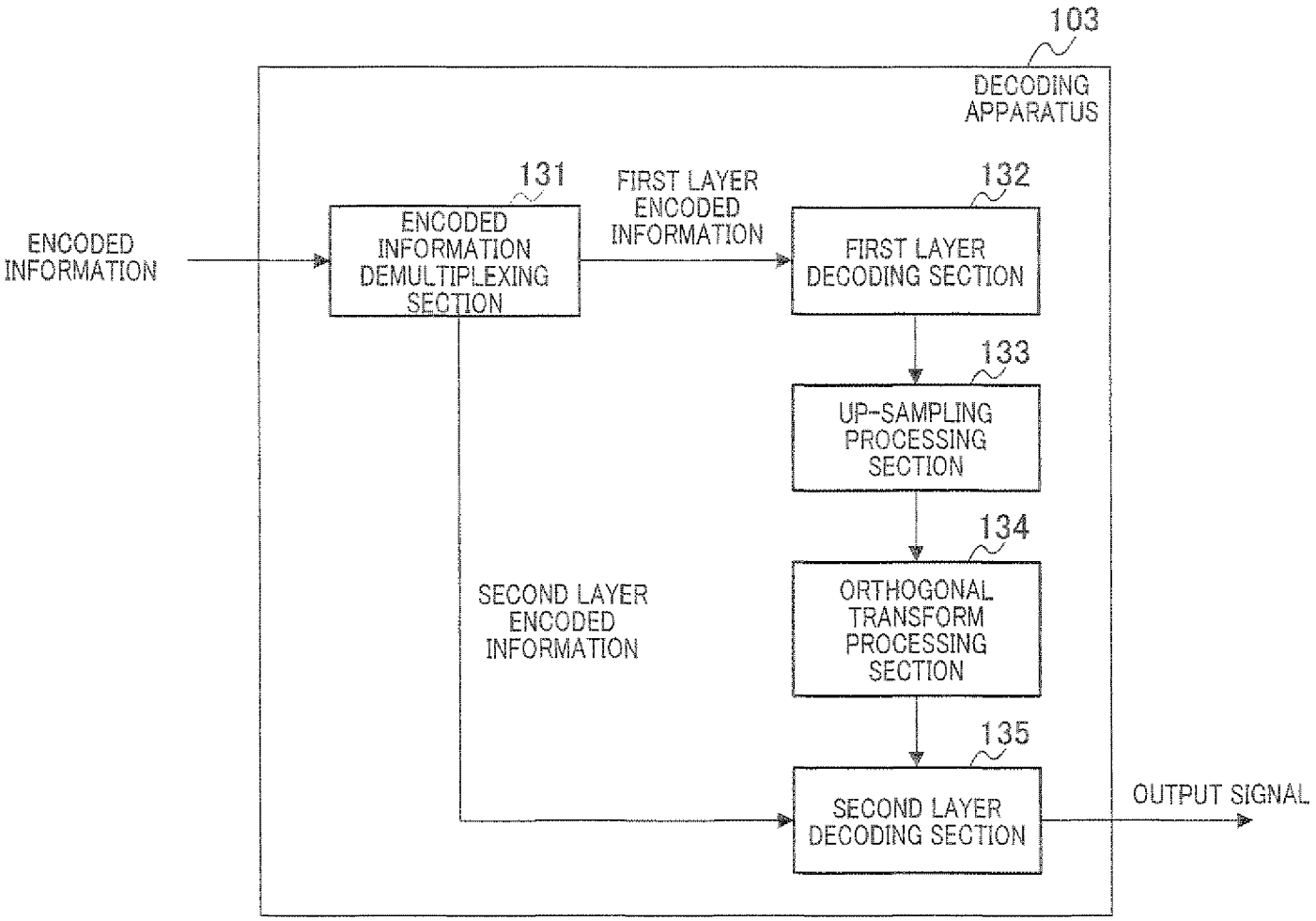
FIG. 8 is a block diagram showing a relevant configuration of the inside of the decoding apparatus shown in FIG. 1 according to Embodiment 1 of the present invention.

FIG. 8 is a block diagram showing a relevant configuration of the inside of decoding apparatus 103.

In FIG. 8, encoded information demultiplexing section 131 demultiplexes the first layer encoded information and the second layer encoded information from among the input encoded information (that is, the encoded information received from encoding apparatus 101), outputs the first layer encoded information to first layer decoding section 132, and outputs the second layer encoded information to second layer decoding section 135.

First layer decoding section 132 decodes the first layer encoded information that is input from encoded information demultiplexing section 131, and outputs a generated first layer decoded signal to up-sampling processing section 133. Operation of first layer decoding section 132 is similar to that of first layer decoding section 203 shown in FIG. 2, and therefore, a detailed explanation of the operation is omitted.

Up-sampling processing section 133 performs a process of up-sampling a sampling frequency from $SR_2$ to $SR_1$ to the first layer decoded signal that is input from first layer decoding section 132, and outputs an obtained up-sampled first layer decoded signal to orthogonal transform processing section 134.

Orthogonal transform processing section 134 performs an orthogonal transform process (MDCT) to the up-sampled first layer decoded signal that is input from up-sampling processing section 133, and outputs an MDCT coefficient of the obtained up-sampled first layer decoded signal (hereinafter, "first layer decoded spectrum") S1(*k*) to second layer decoding section 135. Operation of orthogonal transform processing section 134 is similar to that of orthogonal transform processing section 205 shown in FIG. 2 performed to the up-sampled first layer decoded signal, and therefore, a detailed explanation of the operation is omitted.

Second layer decoding section 135 generates the second layer decoded signal containing a high frequency component, by using the first layer decoded spectrum S1($k$) that is input from orthogonal transform processing section 134 and the second layer encoded information that is input from encoded information demultiplexing section 131, and outputs the generated signal as an output signal.

Figure 9:
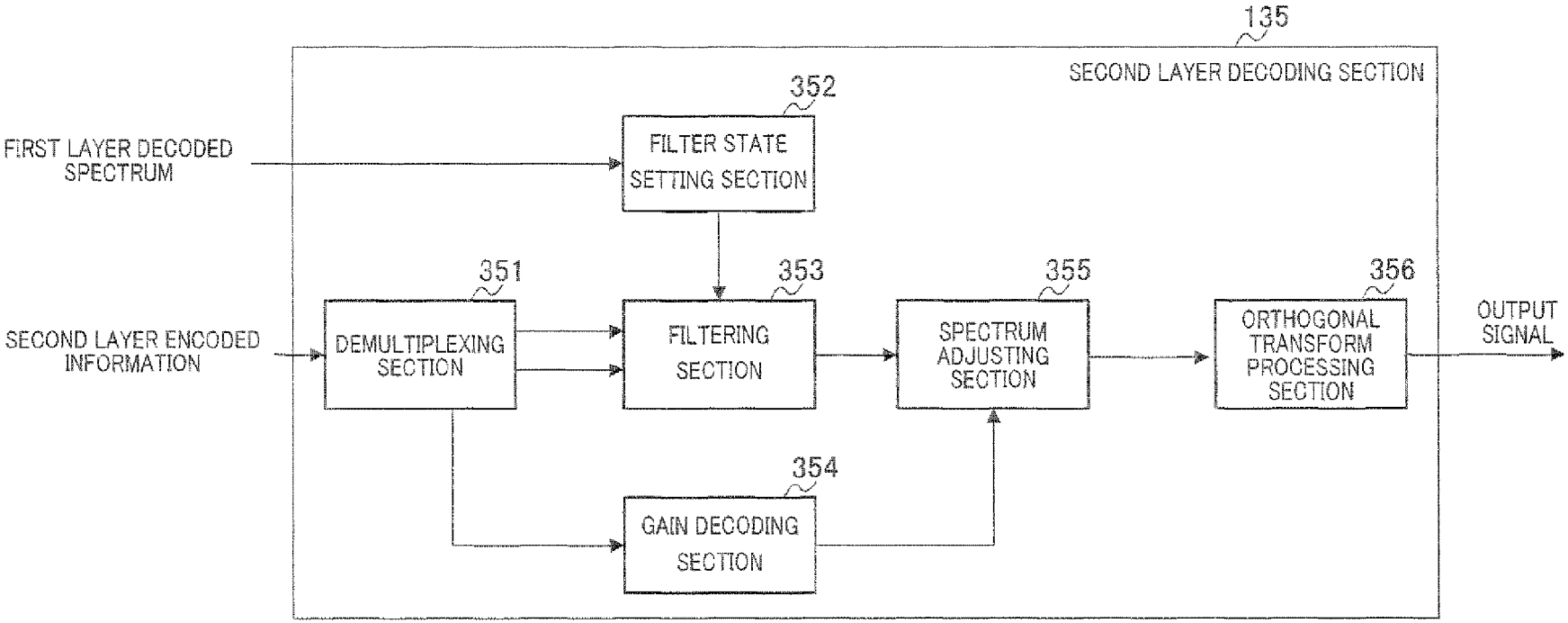
FIG. 9 is a block diagram showing a relevant configuration of the inside of a second layer decoding section shown in FIG. 8 according to Embodiment 1 of the present invention.

FIG. 9 is a block diagram showing a relevant configuration of the inside of second layer decoding section shown in FIG. 8.

Demultiplexing section 351 demultiplexes the second layer encoded information that is input from encoded information demultiplexing section 131, into the band division information that contains the bandwidth $BW_p$ (p=0, 1, . . . , P−1) and the header index $BS_p$ (p=0, 1, . . . , P−1) ($FL \le BS_p < FH$) of each sub-band, the optimal pitch coefficient $T_P'$ (p=0, 1, . . . , P−1) as information concerning filtering, and indexes of ideal gain encoded information (j=0, 1, . . . , J−1) and logarithmic gain encoded information (j=0, 1, . . . , J−1) as information concerning gain. Demultiplexing section 351 outputs the band division information and the optimal pitch coefficient $T_p'$ (p=0, 1, . . . , P−1) to filtering section 353, and outputs the indexes of the ideal gain encoded information and the logarithmic gain encoded information to gain decoding section 354. In encoded information demultiplexing section 131, when the second layer encoded information is already divided into the band division information, the optimal pitch coefficient $T_P'$ (p=0, 1, . . . , P−1), and the indexes of ideal gain encoded information and logarithmic gain encoded information, demultiplexing section 351 does not need to be arranged.

Filter state setting section 352 sets the first layer decoded spectrum S1($k$) ($0 \le k < FL$) that is input from orthogonal transform processing section 134, as a filter state to be used by filtering section 353. When the spectrum of the entire frequency band $0 \le k < FH$ in filtering section 353 is called S(k) for convenience, the first layer decoded spectrum S1($k$) is stored in the band of $0 \le k < FL$ of S(k) as an internal state (a filter state) of the filter. A configuration and operation of filter state setting section 352 are similar to those of filter state setting section 261 shown in FIG. 3, and therefore, a detailed explanation the configuration and operation is omitted.

Filtering section 353 includes a pitch filter of a multi-tap (the number of taps is larger than 1). Filtering section 353 filters the first layer decoded spectrum S1($k$), and calculates the estimated value $S2_p'(k)$ ($BS_p \le k < BS_p + BW_p$) (p=0, 1, . . . , P−1) of each sub-band $SB_p$ (p=0, 1, . . . , P−1) shown in above equation 15, based on the band division information that is input from demultiplexing section 351, the filter state that is set by filter state setting section 352, pitch coefficient $T_p'$ (p=0, 1, . . . , p−1) and the filter coefficient stored in the inside beforehand. A filter function shown in above equation 14 is also used in filtering section 353. However, the filtering process and the filter function in this case are different in that T in equations 14 and 15 are substituted to $T_p'$. That is, filtering section 353 estimates a high frequency part of the input spectrum in encoding apparatus 101 from the first layer decoded spectrum.

Gain decoding section 354 decodes the indexes of the ideal gain encoded information and logarithmic gain encoded information that are input from demultiplexing section 351, and obtains the quantized ideal gain $\alpha Q1_p$ and the quantized logarithmic gain $\alpha 2Q_p$ of the quantized values of the ideal gain $\alpha 1_p$ and the logarithmic gain $\alpha 2_p$.

Spectrum adjusting section 355 calculates a decoded spectrum, based on the estimated value $S2_p'(k)$ ($BS_p \le k < BS_p + BW_p$) (p=0, 1, . . . , P−1) of each sub-band $SB_p$ (p=0, 1, . . . , P−1) that is input from filtering section 353, and the ideal gain $\alpha Q1_p$ for each sub-band that is input from gain decoding section 354. Spectrum adjusting section 355 outputs the calculated decoded spectrum to orthogonal transform processing section 356.

Figure 10:
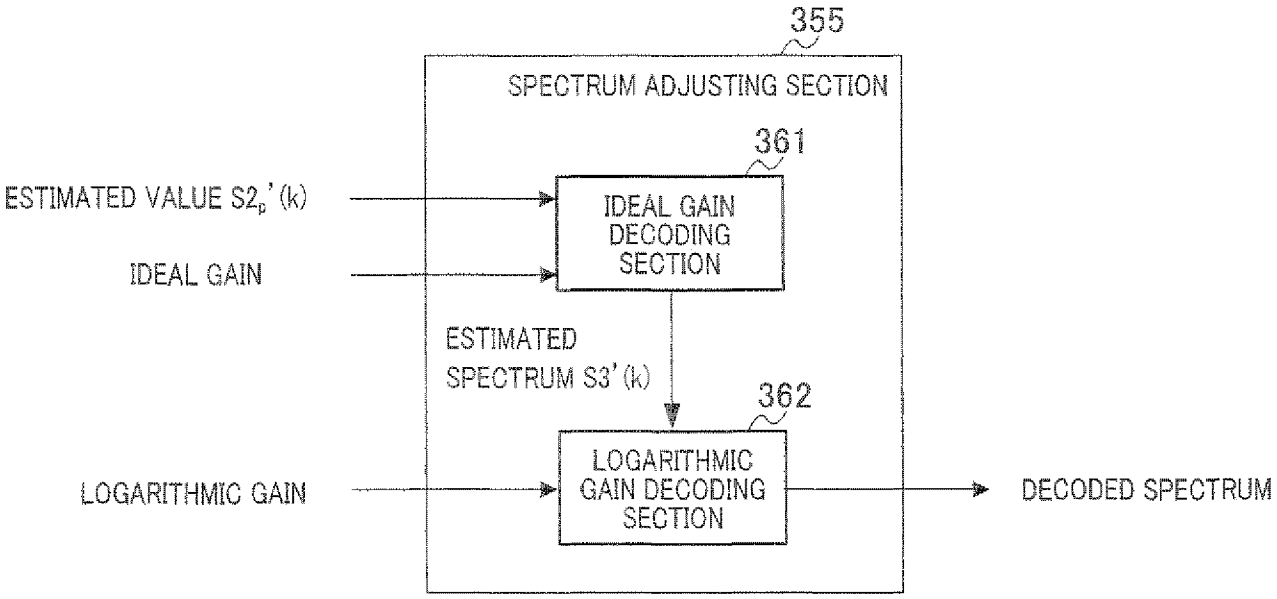
FIG. 10 is a block diagram showing a relevant configuration of the inside of a spectrum adjusting section shown in FIG. 9 according to Embodiment 1 of the present invention.

FIG. 10 shows an internal configuration of spectrum adjusting section 355. Spectrum adjusting section 355 is mainly comprised of ideal gain decoding section 361 and logarithmic gain decoding section 362.

Ideal gain decoding section 361 obtains the estimated spectrum S2'(k) of the input spectrum, by continuing in a frequency part the estimated value $S2_p'(k)$ ($BS_p \le k < BS_p + BW_p$) (p=0, 1, . . . , P−1) of each sub-band that is input from filtering section 353. Next, ideal gain decoding section 361 calculates the estimated spectrum S3'(k) by multiplying the deal gain $\alpha Q1_p$ for each sub-band that is input from gain decoding section 354 to the estimated spectrum S2'(k), based on following equation 17. Ideal gain decoding section 361 outputs the estimated spectrum S3'(k) to logarithmic gain decoding section 362.

Equation 17

$$S3'(k) = S2'(k) \cdot \alpha 1 Q_p (BL_p \le k \le BH_p, \text{ for all } p) \quad [17]$$

Logarithmic gain decoding section 362 performs energy adjustment in the logarithmic domain to the estimated spectrum S3'(k) that is input from ideal gain decoding section 361, by using the quantized logarithmic gain $\alpha 2Q_p$ for each sub-band that is input from gain decoding section 354, and outputs an obtained spectrum to orthogonal transform processing section 356 as a decoded spectrum.

Figure 11:
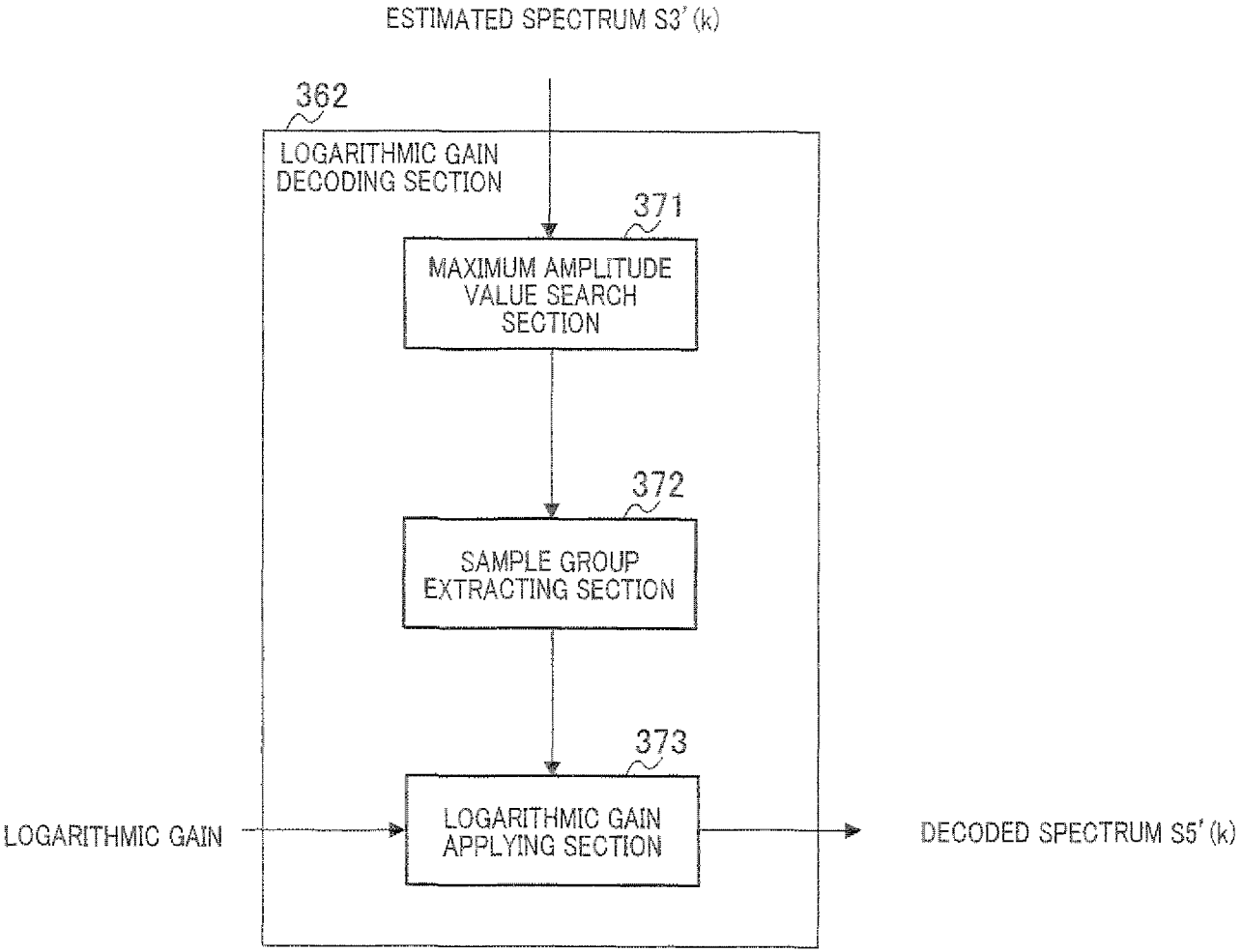
FIG. 11 is a block diagram showing a relevant configuration of the inside of a logarithmic gain decoding section shown in FIG. 10 according to Embodiment 1 of the present invention.

FIG. 11 shows an internal configuration of logarithmic gain decoding section 362. Logarithmic gain decoding section 362 is mainly comprised of maximum amplitude value search section 371, sample group extracting section 372, and logarithmic gain applying section 373.

Maximum amplitude value search section 371 searches for, for each sub-band, the maximum amplitude value $MaxValue_p$, and the maximum amplitude index $MaxIndex_p$ as the index of the sample (a sample component) of a maximum amplitude, to the estimated spectrum S3'(k) that is input from ideal gain decoding section 361, as expressed by equation 11. Maximum amplitude value search section 371 outputs the estimated spectrum S3'(k), the maximum amplitude value $MaxValue_p$, and the maximum amplitude index $MaxIndex_p$, to sample group extracting section 372.

Sample group extracting section 372 determines the extraction flag SelectFlag(k) for each sample, corresponding to the calculated maximum amplitude index $MaxIndex_p$ for each sub-band, as expressed by equation 12. That is, sample group extracting section 372 partially selects a sample, based on a weight that enables a sample (a spectrum component) to be easily selected that is nearer a sample having the maximum amplitude value $MaxValue_p$ in each sub-band. Sample group extracting section 372 outputs the estimated spectrum S3'(k), the maximum amplitude value $MaxValue_p$, and the maximum amplitude index $MaxIndex_p$ and the extraction flag SelectFlag(k) for each sample, to logarithmic gain applying section 373.

Processes performed by maximum amplitude value search section 371 and sample group extracting section 372 are similar to processes performed by maximum amplitude value search section 281 and sample group extracting section 282 of encoding apparatus 101.

Logarithmic gain applying section 373 calculates $Sign_p(k)$ that indicates a sign (+, −) of an extracted sample group, from the estimated spectrum S3'(k) and the extraction flag SelectFlag(k) that are input from sample group extracting section 372, as expressed by equation 18. That is, as expressed by equation 18, logarithmic gain applying section 373 calculates $Sign_p(k)=1$ when the sign of the extracted sample is "+" (when S3'(k)≥0), and calculates $Sign_p(k)=-1$ in other cases (when the sign of the extracted sample is "−" (when $Sign_p(k)$ ≥0).

Equation 18

$$Sign_p(k) = \begin{cases} 1 & (\text{if } S3'(k) \geq 0) \\ -1 & (\text{else}) \end{cases} \quad [18]$$

$$(BL_p \leq k \leq BH_p, \text{ for all } p)$$

Logarithmic gain applying section 373 calculates a decoded spectrum S5'(k), following equations 19 and 20, for a sample where the value of the extraction flag SelectFlag(k) is 1, based on the estimated spectrum S3'(k), the maximum amplitude value $MaxValue_p$, and the extraction flag SelectFlag(k) that are input from sample group extracting section 372, and based on the quantized logarithmic gain $\alpha 2Q_p$ that is input from gain decoding section 354, and the sign $Sign_p(k)$ that is calculated following equation 18.

Equation 19

$$S4'(k) = \alpha 2Q_p \cdot (\log_{10}(S3'(k)) - MaxValue_p) + MaxValue_p \quad [19]$$

$$\begin{pmatrix} \text{if } SelectFlag(k) = 1 \\ BL_p \leq k \leq BH_p, \text{ for all } p \end{pmatrix}$$

Equation 20

$$S5'(k) = 10^{S4'(k)} \cdot Sign_p(k) \begin{pmatrix} \text{if } SelectFlag(k) = 1 \\ BL_p \leq k \leq BH_p, \text{ for all } p \end{pmatrix} \quad [20]$$

That is, logarithmic gain applying section 373 applies the logarithmic gain $\alpha 2_p$ to only a sample that is partially selected by sample extracting section 372 (a sample of the extraction flag SelectFlag(k=1). Logarithmic gain applying section 373 outputs the decoded spectrum S5'(k) to orthogonal transform processing section 356. In this case, a low frequency part (0≤k<FL) of the decoded spectrum S5'(k) is comprised of the first layer decoded spectrum S1(*k*), and a high frequency part (FL≤k<FH) of the decoded spectrum S5'(k) is comprised of the spectrum obtained by performing energy adjustment in the logarithmic domain to the estimated spectrum S3'(k). However, for a sample that is not selected by sample extracting section 372 (a sample of the extraction flag SelectFlag (k)=0), in the high frequency part (FL≤k<FH) of the decoded spectrum S5'(k), a value of this sample is set as the value of the estimated spectrum S3'(k).

Orthogonal transform processing section 356 orthogonally converts the decoded spectrum. S5'(k) that is input from spectrum adjusting section 355 into a signal of a time domain, and outputs an obtained second layer decoded signal as an output signal. In this case, proper windowing and superimposition addition processes are performed when necessary, thereby avoiding discontinuity generated between frames.

A detailed process of orthogonal transform processing section 356 is explained below.

Orthogonal transform processing section 356 has a buffer buf'(k) in its inside, and initializes the buffer buf'(k) as expressed by following equation 21.

Equation 21

$$buf'(k)=0=0(k=0, \ldots, N-1) \quad [21]$$

Orthogonal transform processing section 356 also obtains a second layer decoded signal $y_n''$, based on following equation 22 by using the second layer decoded spectrum S5'(k) that is input from spectrum adjusting section 355.

Equation 22

$$y_n'' = \frac{2}{N} \sum_{n=0}^{2N-1} Z4(k) \cos\left[\frac{(2n+1+N)(2k+1)\pi}{4N}\right] \quad [22]$$

$$(n = 0, \ldots, N-1)$$

In equation 22, Z4(*k*) is vector that combines the decoded spectrum S5'(k) and the buffer buf'(k), as expressed by following equation 23.

Equation 23

$$Z4(k) = \begin{cases} buf'(k) & (k = 0, \ldots N-1) \\ S5'(k) & (k = N, \ldots 2N-1) \end{cases} \quad [23]$$

Orthogonal transform processing section 356 updates the buffer buf'(k) based on following equation 24.

Equation 24

$$buf'(k)=S5'(k)(k=0, \ldots, N-1) \quad [24]$$

Orthogonal transform processing section 356 outputs the decoded signal $y_n''$ as an output signal.

As explained above, according to the present embodiment, in the encoding/decoding for estimating a spectrum of a high frequency part by performing a band expansion by using a spectrum of a low frequency part, the spectrum of the high frequency part is estimated by using a decoded low frequency spectrum, and thereafter, a sample is selected (thinned) by placing a weight on a sample at the periphery of a maximum amplitude value in each sub-band of the estimated spectrum, and a gain adjustment in the logarithmic domain is performed for only the selected sample. Based on this configuration, the volume of arithmetic operations necessary for the gain adjustment in the logarithmic domain can be substantially reduced. Further, by performing a gain adjustment to only an acoustically important sample near the maximum amplitude value, generation of abnormal sound which results in amplification of a sample of a low amplitude value can be suppressed, and sound quality of a decoded signal can be improved.

In the present embodiment, in the setting of an extraction flag, a value of the extraction flag is set to 1 when the index is an even number, for a sample which is not near the sample having a maximum amplitude value within a sub-band. However, application of the present invention is not limited to this, and the invention can be similarly applied to the case where a value of an extraction flag of a sample in which a surplus to the index 3 is 0 is set to 1, for example. That is, application of the present invention is not limited to the above setting method of an extraction flag, and the present invention can be similarly applied to a method of extracting a sample based on a weight (a scale) that enables a value of an extraction flag to be easily set to 1 for a sample that is nearer a sample having the maximum amplitude value, corresponding to a position of the maximum amplitude value within a sub-band. For example, there is a setting method of an extraction flag in three step that the encoding apparatus and the decoding apparatus extract all samples that are very near a sample having the maximum amplitude value (that is, the encoding apparatus and the decoding apparatus set a value of the extraction flag to 1), extract samples that are slightly far from the maximum amplitude value only when the index is an even number, and extract samples that are farther from the maximum amplitude value when a surplus to the index 3 is 0. Needless to mention, the present invention can be also applied to a setting method in more than three steps.

In the present embodiment, in the setting of an extraction flag, it is explained as an example that after a sample that has a maximum amplitude value within a sub-band is searched for, an extraction flag is set corresponding to a distance from this sample. However, application of the present embodiment is not limited to this, and the invention can be also applied to the case where the encoding apparatus and the decoding apparatus search for a sample that has a minimum amplitude value, set an extraction flag of each sample corresponding to a distance from the sample that has a minimum amplitude value, and calculate and apply an amplitude adjustment parameter of a logarithmic gain and the like to only the extracted sample (the sample where the value of an extraction flag is set to 1), for example. This configuration is valid when the amplitude adjustment parameter has an effect of attenuating the estimated high frequency spectrum, for example. Although there is a risk of generating abnormal sound by attenuating the high frequency spectrum to a sample having a large amplitude, there is a possibility of improving the sound quality by applying an attenuation process to only the periphery of the sample having the minimum amplitude value. There is also a configuration that the encoding apparatus and the decoding apparatus extract a sample by using a weight (a scale) that enables a sample to be easily extracted that is farther from a sample having a maximum amplitude value by searching for the maximum amplitude value, instead of searching for a minimum amplitude value. The present invention can be also similarly applied to this configuration.

In the present embodiment, in the setting of an extraction flag, it is explained as an example that after a sample that has a maximum amplitude value within a sub-band is searched for, an extraction flag is set corresponding to a distance from this sample. However, application of the present embodiment is not limited to this, and the invention can be similarly applied to the case where a sample flag is set to a plurality of samples corresponding to a distance from each sample, by selecting these samples from samples having a larger amplitude, for each sub-band. By providing the above configuration, a sample can be efficiently extracted, when a plurality of samples that have near sizes of amplitudes are present within a sub-band.

In the present embodiment, the case is explained where a sample is partially selected by determining whether a sample within each sub-band is near a sample that has a maximum amplitude value, based on a threshold value ($Near_p$ expressed in equation 12). In the present invention, the encoding apparatus and the decoding apparatus can be arranged to select a sample of a broader range for a sub-band in a higher frequency among a plurality of sub-bands, as a sample that is near the sample having a maximum amplitude value, for example. That is, in the present invention, $Near_p$ that is expressed in equation 12 can take a larger value for a sub-band of a higher frequency among a plurality of sub-bands. With this arrangement, at a band division time, even when a sub-band width is set to be larger for a higher frequency like a Bark scale, for example, a sample can be partially selected without deviation between sub-bands, and degradation of sound quality of a decoded signal can be prevented. It is experimentally confirmed that, for a value of $Near_p$ that is expressed by equation 12, a good result is obtained by setting about 5 to 21 (for example, a value of $Near_p$ in a lowest frequency sub-band is 5, and a value of $Near_p$ in a highest frequency sub-band is 21) when the number of samples (MDCT coefficients) of one frame is about 320, for example.

In the present embodiment, a configuration of the encoding apparatus and the decoding apparatus is explained that the sample group detecting section partially selects a sample based on a weight that enables a sample to be easily selected that is nearer a sample having the maximum amplitude value $MaxValue_p$ in each sub-band, as expressed by equation 12. In this case, by a sample group extracting method that is expressed by equation 12, a sample near the maximum amplitude value can be easily selected, regardless of a boundary of a sub-band, even when a sample having the maximum amplitude value is present in the boundary of each sub-band. That is, according to the configuration explained in the present embodiment, because a sample is selected by considering a position of a sample that has the maximum amplitude value within an adjacent sub-band, an acoustically important sample can be efficiently selected.

In the present embodiment, the maximum amplitude value search section calculates a maximum amplitude in a linear domain not in a logarithmic domain. When a logarithmic transform is performed to all samples (the MDCT coefficients) (for example, Patent Literature 1 and the like), the volume of arithmetic operations does not increase so much when a maximum amplitude value is calculated in the logarithmic domain or in the linear domain. However, like in the configuration of the present embodiment, when a logarithmic transform is performed to a partially selected sample, the volume of arithmetic operations when calculating a maximum amplitude value can be reduced more than that by a method in Patent Literature 1 and the like, for example, when the maximum amplitude value search section calculates the maximum amplitude value in the linear domain as described above.

Embodiment 2

In Embodiment 2 of the present invention, a gain encoding section within the second layer encoding section can further reduce the volume of arithmetic operations by using a configuration which is different from the configuration explained in Embodiment 1.

A communication system (not shown) according to Embodiment 2 is basically similar to the communication system shown in FIG. 1, and is different from encoding apparatus 101 and decoding apparatus 103 of the communication system in FIG. 1 in only a part of a configuration and operation of the encoding apparatus and the decoding apparatus. Embodiment 2 is explained below by adding reference numbers 111 and 113 respectively to the encoding apparatus and the decoding apparatus according to the present embodiment.

The inside of encoding apparatus 111 (not shown) according to the present embodiment is mainly comprised of down-sampling processing section 201, first layer encoding section 202, first layer decoding section 203, up-sampling processing section 204, orthogonal transform processing section 205, second layer encoding section 206, and encoded information multiplexing section 207. Constituent elements other than second layer encoding section 226 perform the same processes as those in Embodiment 1 (FIG. 2), and therefore, their explanation is omitted.

Second layer encoding section 226 generates the second layer encoded information by using the input spectrum $S2(k)$ and the first layer decoded spectrum $S1(k)$ that are input from orthogonal transform processing section 205, and outputs the generated second layer encoded information to encoded information multiplexing section 207.

Figure 12:
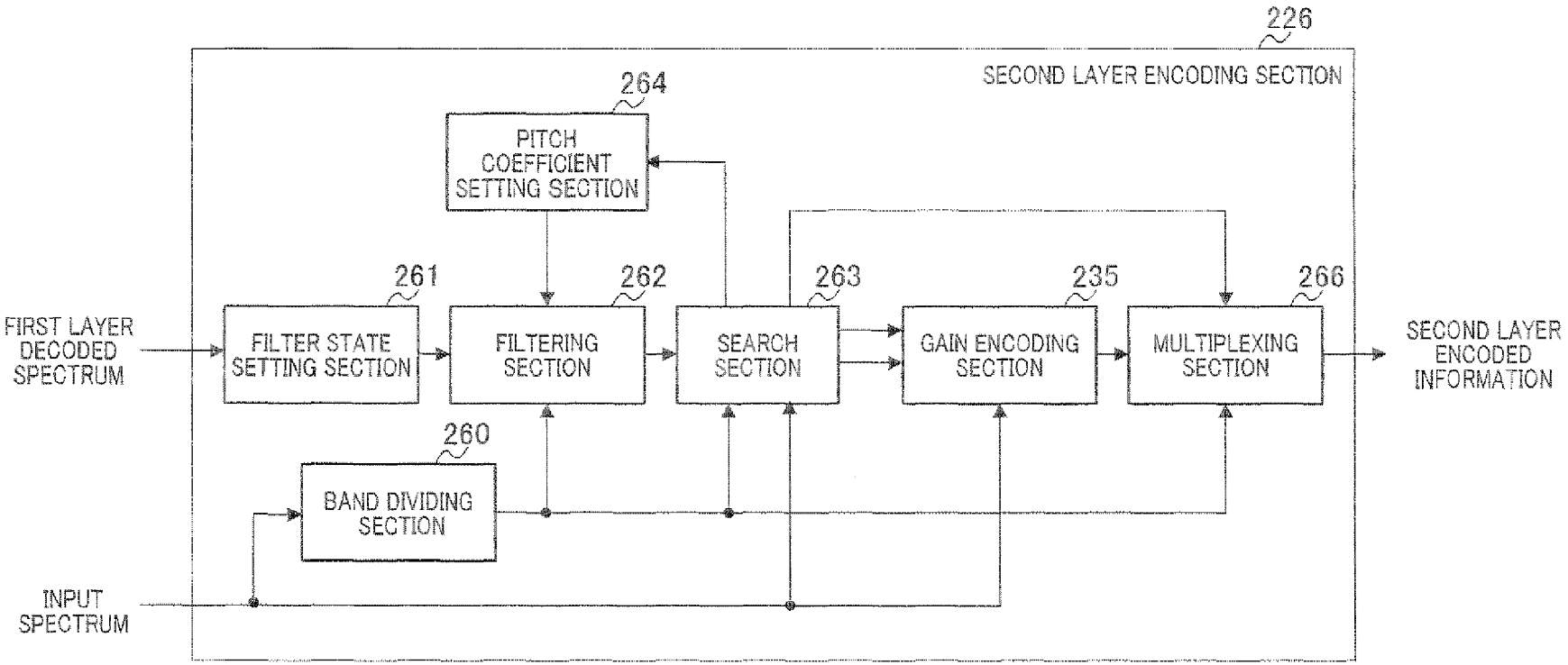
FIG. 12 is a block diagram showing a relevant configuration of the inside of a second layer encoding section according to Embodiment 2 of the present invention.

Next, a relevant configuration of the inside of second layer encoding section 226 is explained with reference to FIG. 12.

Second layer encoding section 206 includes band dividing section 260, filter state setting section 261, filtering section 262, search section 263, pitch coefficient setting section 264, gain encoding section 235, and multiplexing section 266, and each section performs the following operation. Constituent elements other than gain encoding section 235 are the same as the constituent elements explained in Embodiment 1 (FIG. 3), and therefore, their explanation is omitted.

Gain encoding section 235 calculates for each sub-band, a logarithmic gain as a parameter (an amplitude adjustment parameter) for adjusting an energy ratio in a nonlinear domain, based on the input spectrum S2($k$), and the estimated spectrum S$\mathbf{2}_p$'(k) (p=0, 1, . . . , P−1) and the deal gain $\alpha\mathbf{1}_p$ of each sub-band that are input from search section 263. Gain encoding section 235 quantizes the ideal gain and the logarithmic gain, and outputs the quantized ideal gain and the quantized logarithmic gain to multiplexing section 266.

Figure 13:
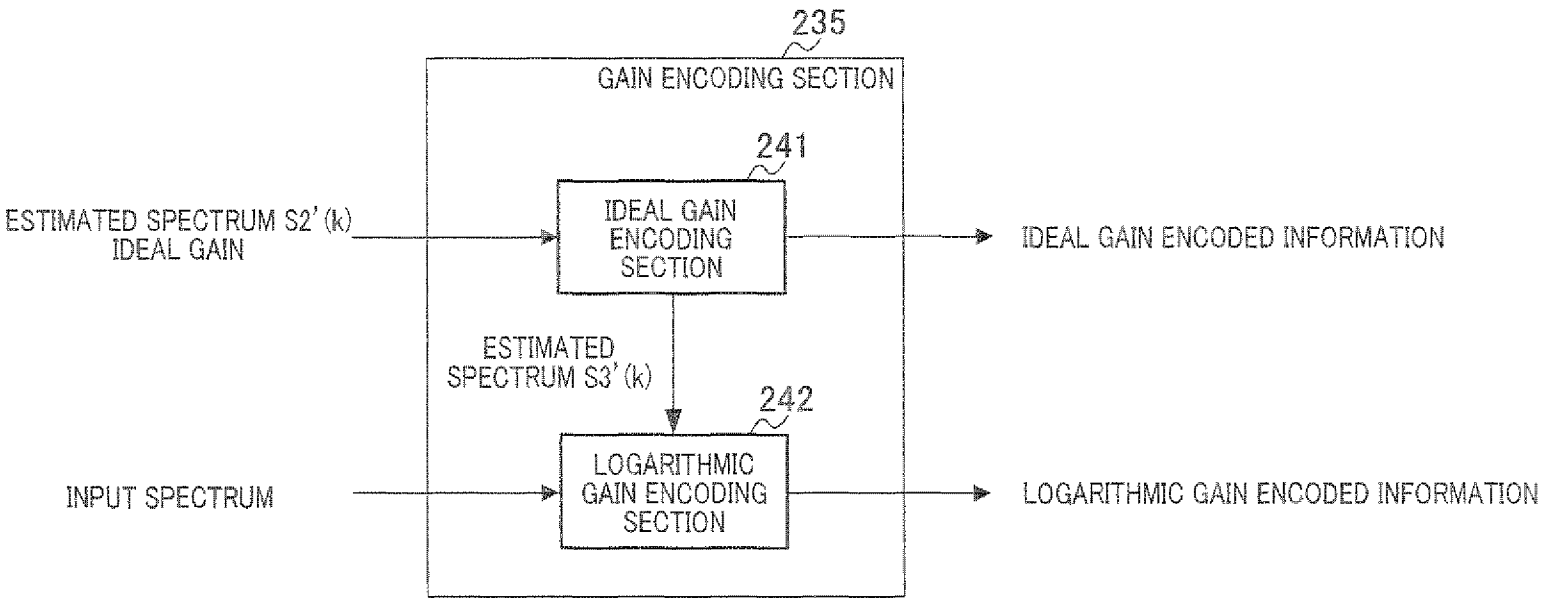
FIG. 13 is a block diagram showing a relevant configuration of the inside of a gain encoding section shown in FIG. 12 according to Embodiment 2 of the present invention.

FIG. 13 shows an internal configuration of gain encoding section 235. Gain encoding section 235 is mainly comprised of ideal gain encoding section 241 and logarithmic gain encoding section 242. Ideal gain encoding section 241 is the same constituent element as that explained in Embodiment 1, and therefore explanation of ideal gain encoding section 241 is omitted.

Logarithmic gain encoding section 242 calculates a logarithmic gain as a parameter (an amplitude adjustment parameter) for adjusting an energy ratio in the nonlinear domain for each sub-band between the high frequency part (FL≤k<FH) of the input spectrum S2($k$) that is input from orthogonal transform processing section 205 and the estimated spectrum S3'(k) that is input from ideal gain encoding section 241. Logarithmic gain encoding section 242 outputs the calculated logarithmic gain to multiplexing section 266 as logarithmic gain encoded information.

Figure 14:
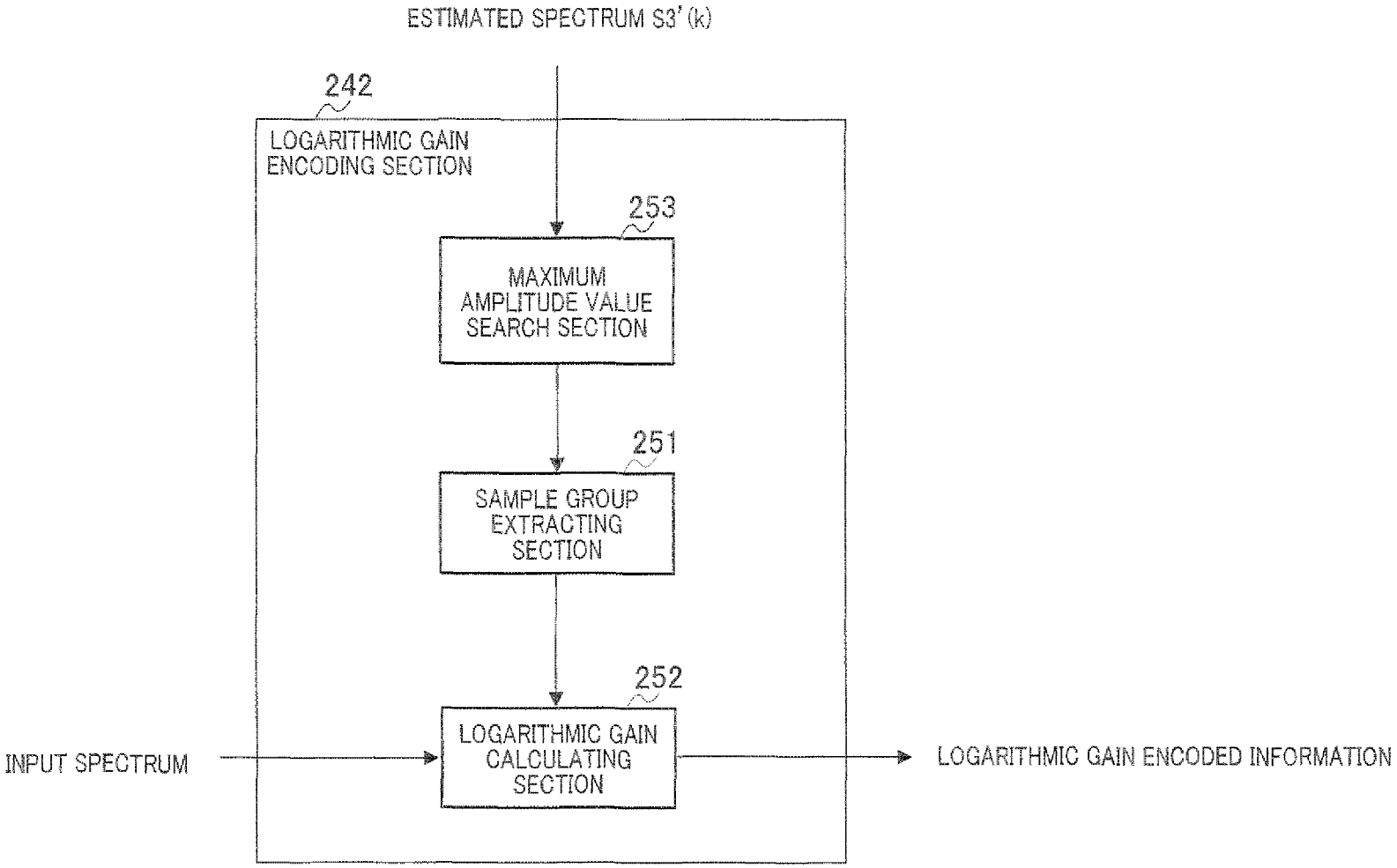
FIG. 14 is a block diagram showing a relevant configuration of the inside of a logarithmic gain encoding section shown in FIG. 13 according to Embodiment 2 of the present invention.

FIG. 14 shows an internal configuration of logarithmic gain encoding section 242. Logarithmic gain encoding section 242 is mainly comprised of maximum amplitude value search section 253, sample group extracting section 251, and logarithmic gain calculating section 252.

Maximum amplitude value search section 253 searches for, for each sub-band, a maximum amplitude value MaxValue$_p$, and an index of a sample (a spectrum component) of a maximum amplitude, that is, a maximum amplitude index MaxIndex$_p$, for the estimated spectrum S3'(k) that is input from ideal gain encoding section 241, as expressed by equation 25.

Equation 25

$$\begin{cases} MaxValue_p = \max(|S3'(k)|) \\ MaxIndex_p = k \text{ where } MaxValue_p = |S3'(k)| \end{cases} \quad [25]$$

$$(BL_p \le k \le BH_p,\ (k = 0, 2, 4, 6, \ldots \text{ (even)}),\ \text{for all } p)$$

That is, maximum amplitude value search section 253 searches for a maximum amplitude value for only a sample of an even-numbered index. With this arrangement, the volume of arithmetic operations required to search for a maximum amplitude value can be efficiently reduced.

Maximum amplitude value search section 253 outputs the estimated spectrum S3'(k), the maximum amplitude value MaxValue$_p$, and the maximum amplitude index MaxIndex$_p$ to sample group extracting section 251.

Sample group extracting section 251 determines a value of an extraction flag SelectFlag(k) for each sample (a spectrum component) to the estimated spectrum S3'(k) that is input from maximum amplitude value search section 253, based on following equation 26.

Equation 26

$$SelectFlag(k) = \begin{cases} 0 & k = 1, 3, 5, 7, 9, \ldots \text{ (odd)} \\ 1 & k = 0, 2, 4, 6, 8, \ldots \text{ (even)} \end{cases} \quad [26]$$

$$(BL_p \le k \le BH_p,\ \text{for all } p)$$

That is, sample group extracting section 251 sets a value of the extraction flag SelectFlag(k) to 0 for a sample of an odd-numbered index, and sets a value of the extraction flag SelectFlag(k) to 1 for a sample of an even-numbered index, as expressed by equation 26. That is, sample group extracting section 251 partially selects a sample (a spectrum component) (only the sample of the index of an even number), to the estimated spectrum S3'(k). Sample group extracting section 251 outputs the extraction flag SelectFlag(k), the estimated spectrum S3'(k), and the maximum amplitude value MaxValue$_p$ to logarithmic gain calculating section 252.

Logarithmic gain calculating section 252 calculates an energy ratio (a logarithmic gain) $\alpha\mathbf{2}_p$ in a logarithmic domain between the estimated spectrum S3'(k) and the high frequency part (FL≤k<FH) of the input spectrum S2($k$), based on the equation 13, for a sample where the value of the extraction flag SelectFlag(k) that is input from sample group extracting section 251 is 1. That is, logarithmic gain calculating section 252 calculates the logarithmic gain $\alpha\mathbf{2}_p$ for only a sample that is partially selected by sample group extracting section 251.

Logarithmic gain calculating section 252 quantizes the logarithmic gain $\alpha\mathbf{2}_p$, and outputs a quantized logarithmic gain $\alpha\mathbf{2}Q_p$ to multiplexing section 266 as logarithmic gain encoded information.

The process by gain encoding section 235 is explained above.

The process of encoding apparatus 111 according to the present embodiment is as explained above.

On the other hand, the inside of decoding apparatus 113 (not shown) according to the present embodiment is mainly comprised of encoded information demultiplexing section 131, first layer decoding section 132, up-sampling processing section 133, orthogonal transform processing section 134, and second layer decoding section 295. Constituent elements other than second layer decoding section 295 perform the same processes as those in Embodiment 1 (FIG. 8), and therefore, their explanation is omitted.

Second layer decoding section 295 generates the second layer decoded signal containing a high frequency component, by using the first layer decoded spectrum S1($k$) that is input from orthogonal transform processing section 134 and the second layer encoded information that is input from encoded information demultiplexing section 131, and outputs the generated signal as an output signal.

Second layer decoding section 295 is mainly comprised of demultiplexing section 351, filter state setting section 352, filtering section 353, gain decoding section 354, spectrum adjusting section 396, and orthogonal transform processing section 356. Constituent elements other than spectrum adjusting section 396 perform the same processes as those in Embodiment 1 (FIG. 9), and therefore, their explanation is omitted.

Spectrum adjusting section 396 is mainly comprised of ideal gain decoding section 361 and logarithmic gain decoding section 392 (not shown). Ideal gain decoding section 361 performs the same process as that in Embodiment 1 (FIG. 10), and therefore, explanation of ideal gain decoding section 361 is omitted.

Figure 15:
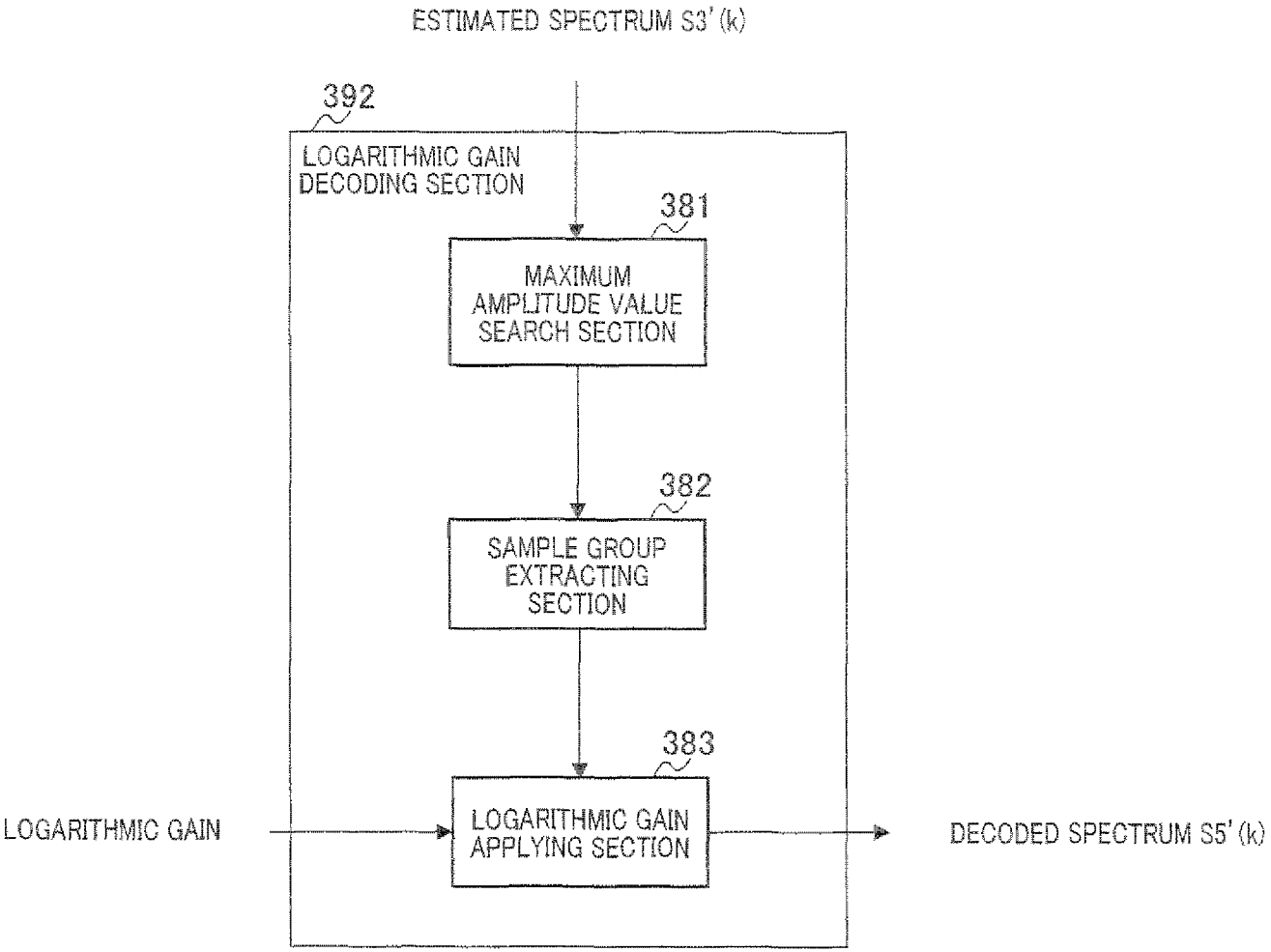
FIG. 15 is a block diagram showing a relevant configuration of the inside of a logarithmic gain decoding section according to Embodiment 2 of the present invention.

FIG. 15 shows an internal configuration of logarithmic gain decoding section 392. Logarithmic gain encoding section 392 is mainly comprised of maximum amplitude value search section 381, sample group extracting section 382, and logarithmic gain applying section 383.

Maximum amplitude value search section 381 searches for, for each sub-band, a maximum amplitude value $MaxValue_p$, and an index of a sample (a spectrum component) of a sample of a maximum amplitude, that is, a maximum amplitude index $MaxIndex_p$, for the estimated spectrum S3'(k) that is input from ideal gain decoding section 361, as expressed by equation 25. That is, maximum amplitude value search section 381 searches for a maximum amplitude value for only a sample of an even-numbered index. That is, maximum amplitude value search section 381 searches for a maximum amplitude value for only a part of a sample (a spectrum component) out of the estimated spectrum S3'(k). With this arrangement, the volume of arithmetic operations required to search for a maximum amplitude value can be efficiently reduced. Maximum amplitude value search section 381 outputs the estimated spectrum S3'(k), the maximum amplitude value $MaxValue_p$, and the maximum amplitude index $MaxIndex_p$ to sample group extracting section 382.

Sample group extracting section 382 determines the extraction flag SelectFlag(k) for each sample, corresponding to the calculated maximum amplitude index $Maxindex_p$ for each sub-band, as expressed by equation 12. That is, sample group extracting section 382 partially selects a sample, based on a weight that enables a sample (a spectrum component) to be easily selected that is nearer a sample having the maximum amplitude value $MaxValue_p$ in each sub-band. Specifically, sample group extracting section 382 selects a sample of an index that indicates that a distance from the maximum amplitude value $MaxValue_p$ is within a range of $Near_p$, as expressed by equation 12. Further, sample group extracting section 382 sets a value of the extraction flag SelectFlag(k) to 1 for a sample of an even-numbered index even when the sample is not near a sample having a maximum amplitude value, as expressed by equation 12. Accordingly, even when a sample having a large amplitude is present in a band far from a sample having a maximum amplitude value, this sample or a sample having an amplitude near the sample this sample can be extracted. Sample group extracting section 382 outputs the estimated spectrum S3'(k), and the maximum amplitude value $MaxValue_p$ and the extraction flag SelectFlag(k) for each sub-band to logarithmic gain calculating section 383.

Processes performed by maximum amplitude value search section 381 and sample group extracting section 382 are similar to processes performed by maximum amplitude value search section 253 and sample group extracting section 282 of encoding apparatus 101.

Logarithmic gain applying section 383 calculates $Sign_p(k)$ that indicates a sign (−, −) of an extracted sample group, from the estimated spectrum S3'(k) and the extraction flag SelectFlag(k) that are input from sample group extracting section 382, as expressed by equation 18. That is, as expressed by equation 18, logarithmic gain applying section 383 calculates $Sign_p(k)=1$ when the sign of the extracted sample is "+" (when $S3'(k)\geq 0$), and calculates $Sign_p(k)=-1$ in other cases (when the sign of the extracted sample is "−" (when $Sign_p(k)\geq 0$).

Logarithmic gain applying section 383 calculates a decoded spectrum S5'(k), following equations 19 and 20, for a sample where the value of the extraction flag SelectFlag(k) is 1, based on the estimated spectrum S3'(k), the maximum amplitude value $MaxValue_p$, and the extraction flag SelectFlag(k) that are input from sample group extracting section 382, and based on the quantized logarithmic gain $\alpha 2Q_p$ that is input from gain decoding section 354, and the sign $Sign_p(k)$ that is calculated following equation 18.

That is, logarithmic gain applying section 383 applies the logarithmic gain $\alpha 2_p$ to only a sample that is partially selected by sample extracting section 382 (a sample of the extraction flag SelectFlag(k=1). Logarithmic gain applying section 383 outputs the decoded spectrum S5'(k) to orthogonal transform processing section 356. In this case, a low frequency part ($0\leq k<FL$) of the decoded spectrum S5'(k) is comprised of the first layer decoded spectrum $S1(k)$, and a high frequency part ($FL\leq k<FH$) of the decoded spectrum S5'(k) is comprised of the spectrum obtained by performing energy adjustment in the logarithmic domain to the estimated spectrum S3'(k). However, for a sample that is not selected by sample extracting section 382 (a sample of the extraction flag SelectFlag (k)=0), in the high frequency part ($FL\leq k<FH$) of the decoded spectrum S5'(k), a value of this sample is set as the value of the estimated spectrum S3'(k).

The process of spectrum adjusting section 396 is explained above.

The process of decoding apparatus 113 according to the present embodiment is as explained above.

As explained above, according to the present embodiment, in the encoding/decoding for estimating a spectrum of a high frequency part by performing a band expansion by using a spectrum of a low frequency part, the spectrum of the high frequency part is estimated by using a decoded low frequency spectrum, and thereafter, a sample is selected (thinned) in each sub-band of the estimated spectrum, and a gain adjustment in the logarithmic domain is performed for only the selected sample. Unlike in Embodiment 1, the encoding apparatus and the decoding apparatus calculate a gain adjustment parameter (a logarithmic gain) without taking into account a distance from a maximum amplitude value, and the decoding apparatus takes into account a distance from a maximum amplitude value within the sub-band only when a gain adjustment parameter (a logarithmic gain) is applied. Based on this configuration, the volume of arithmetic operations can be reduced more than that in Embodiment 1.

As explained in the present embodiment, it is confirmed by experiments that there is no degradation of sound quality, even when the encoding apparatus calculates a gain adjustment parameter from only a sample of an even index, and when the decoding apparatus takes into account a distance from a sample having a maximum amplitude value within a sub-band and applies a gain adjustment parameter to an extracted sample. That is, it can be said that there is no problem even when a sample group to be used for calculating a gain adjustment parameter does not necessary match a sample group to be used for applying the gain adjustment parameter. This indicates, as explained in the present embodiment, for example, that the encoding apparatus and the decoding apparatus can efficiently calculate a gain adjustment parameter even when all samples are not extracted, by uniformly extracting samples in whole sub-bands. This also indicates that the decoding apparatus can efficiently reduce the volume of arithmetic operations by applying the obtained gain adjustment parameter to only samples extracted by taking into account a distance from a sample having a maximum amplitude value within a sub-band. According to the present embodiment, the volume of arithmetic operations is more reduced than that in Embodiment 1, without degrading sound quality, by employing this configuration.

In the present embodiment, it is explained as an example that the encoding/decoding process of a low frequency component of an input signal and the encoding/decoding process of a high frequency component of an input signal are performed separately, that is, the encoding/decoding process is performed in a layered structure of two layers. However, application of the present invention is not limited to this, and the invention can be also similarly applied to the case of performing the encoding/decoding in a layered structure of three or more layers. When a layered encoding section of three or more layers is considered, in a second layer decoding section that generates a local decoded signal of a second layer decoding section, a sample group to which a gain adjustment parameter (a logarithmic gain) is applied can be a sample group which does not take into account a distance from a sample having a maximum amplitude value which is calculated within the encoding apparatus according to the present embodiment, or can be a sample group which takes into account a distance from a sample having a maximum amplitude value which is calculated within the decoding apparatus according to the present embodiment.

In the present embodiment, in the setting of an extraction flag, a value of the extraction flag is set to 1 only when an index of a sample is an even number. However, application of the present invention is not limited to this, and the invention can be also similarly applied to the case where a surplus to the index 3 is 0, for example.

Each embodiment of the present invention is explained above.

In the above embodiments, it is explained as an example that a number J of sub-bands obtained by dividing the high frequency part of the input spectrum S2($k$) in gain encoding section 265 (or gain encoding section 235) is different from a number F of sub-bands obtained by dividing the high frequency part of the input spectrum S2($k$) in search section 263. However, setting is not limited to this method in the present invention, and a number of sub-bands obtained by dividing the high frequency part of the input spectrum S2($k$) in gain encoding section 265 (or gain encoding section 235) can be set to P.

In the above embodiments, a configuration is explained that estimates a high frequency part of the input spectrum by using a low frequency part of the first layer decoded spectrum obtained from the first layer decoding section. However, a configuration is not limited to this in the present invention, and the invention can be also similarly applied to a configuration that estimates a high frequency part of the input spectrum by using a low frequency part of the input spectrum instead of the first layer decoded spectrum. In this configuration, the encoding apparatus calculates encoded information (the second layer encoded information) for generating a high frequency component of the input spectrum from a low frequency component of the input spectrum, and the decoding apparatus applies this encoded information to the first layer decoded spectrum, and generates a high frequency component of a decoded spectrum.

In the above embodiments, a process is explained as an example that reduces the volume of arithmetic operations and improves sound quality in the configuration that calculates and applies a parameter for adjusting an energy ratio in a logarithmic domain based on the process in Patent Literature 1. However, application of the present invention is not limited to this, and the invention can be similarly applied to a configuration that adjusts an energy ratio in a nonlinear domain transform other than a logarithmic transform. The invention can be also applied to a linear domain transform as well as a nonlinear domain transform.

In the above embodiments, a process is explained as an example that reduces the volume of arithmetic operations and improves sound quality in the configuration that calculates and applies a parameter for adjusting an energy ratio in a logarithmic domain in a band expansion process based on the process in Patent Literature 1. However, application of the present invention is not limited to this, and the invention can be also similarly applied to a process other than the band expansion process.

The encoding apparatus, the decoding apparatus, and the method therefor are not limited to the above embodiments, and various modifications can be also implemented. For example, these embodiments can be suitably combined for implementation.

In the above embodiments, it is explained as an example that the decoding apparatus performs a process by using encoded information transmitted from the encoding apparatus in each embodiment. However, the process is not limited to the above in the present invention, and the decoding apparatus can also perform the process by using encoded information that contains necessary parameters and data, by not necessarily using encoded information from the encoding apparatus in the above embodiments.

In the above embodiments, although a speech signal is explained to be encoded, a music signal can be also encoded, and an acoustic signal that contains both of these signals can be also encoded.

The present invention can be also applied to the case of recording and writing a signal processing program into a mechanically readable recording medium such as a memory, a disk, a tape, a CD, and a DVD, and performing operation, and can also obtain operation and effects similar to those in the present embodiments.

Also, although cases have been described with the above embodiment as examples where the present invention is configured by hardware, the present invention can also be realized by software.

Each function block employed in the description of each of the aforementioned embodiments may typically be implemented as an LSI constituted by an integrated circuit. These may be individual chips or partially or totally contained on a single chip. "LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of a programmable FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology.

The disclosures of Japanese Patent Application No. 2009-044676, filed on Feb. 26, 2009, Japanese Patent Application No. 2009-089656, filed on Apr. 2, 2009, and Japanese Patent Application No. 2010-001654, filed on Jan. 7, 2010, including the specifications, drawings, and abstracts, are incorporated herein by reference in their entirety.

INDUSTRIAL APPLICABILITY

The encoding apparatus, the decoding apparatus, and the method therefor according to the present invention can improve quality of a decoded signal when estimating a spectrum of a high frequency part by performing a band expansion by using a spectrum of a low frequency part, and can be applied to a packet communication system, and a mobile communication system, for example.

REFERENCE SIGNS LIST

101 Encoding apparatus
102 Transmission channel
103 Decoding apparatus
201 Down-sampling processing section
202 First layer encoding section
132, 203 First layer decoding sections
133, 204 Up-sampling processing sections
134, 205, 356 Orthogonal transform processing sections
206, 226 Second layer encoding sections
207 Encoded information multiplexing section
260 Band dividing section
261, 352 Filter state setting sections
262, 353 Filtering sections
263 Search section
264 Pitch coefficient setting section
235, 265 Gain encoding sections
266 Multiplexing section
241, 271 Ideal gain encoding sections
242, 272 Logarithmic gain encoding section
253, 281, 371, 381 Maximum amplitude value search section
251, 282, 372, 382 Sample group extracting sections
252, 283 Logarithmic gain calculating sections
131 Encoded information demultiplexing section
135 Second layer decoding section
351 Demultiplexing section
354 Gain decoding section
355 Spectrum adjusting section
361 Ideal gain decoding section
362 Logarithmic gain decoding section
373, 383 Logarithmic gain applying sections

The invention claimed is:

1. An encoding apparatus comprising:

a first encoder structured to generate first encoded information by encoding a lower frequency part of an input signal equal to or lower than a predetermined frequency;

a decoder structured to generate a decoded signal by decoding the first encoded information; and a second encoder structured to generate second encoded information by dividing a high frequency part of the input signal higher than the predetermined frequency into a plurality of sub-bands, estimating the plurality of sub-bands respectively from the decoded signal, selecting a spectrum component within each of the sub-bands, and calculating a second amplitude adjustment parameter for adjusting an amplitude for the selected spectrum component, the second amplitude adjustment parameter being a correlation value of the selected spectrum component and the input signal in a logarithmic domain, wherein the second encoder comprises:

a similar part searcher structured to search for a band which is most similar to a spectrum of each of the plurality of sub-bands and a first amplitude adjustment parameter from a spectrum of the decoded signal;

an amplitude value searcher structured to search for, for each of the sub-bands, a spectrum component having a maximum amplitude value for a spectrum of a high frequency that is estimated by the most similar band and the first amplitude adjustment parameter;

a spectrum component selector structured to select a spectrum component that is present in a region that has a wider bandwidth than a bandwidth of the spectrum component having the maximum amplitude value, the spectrum component having the maximum amplitude value being located at the center of the region; and an amplitude adjustment parameter calculator structured to calculate the second amplitude adjustment parameter that is the correlation value of the selected spectrum component and the input signal in a logarithmic domain, for the selected spectrum component.

2. The encoding apparatus according to claim 1, wherein the second encoder comprises:

a divider structured to divide the high frequency part of the input signal into P (P is an integer larger than 1) sub-bands, and obtains respective start positions and bandwidths of the P sub-bands as band division information;

a filter structured to filter the decoded signal, and generate P p-th (p=1, 2, . . . , P) estimated signals from a first estimated signal to a P-th estimated signal;

a setter structured to set pitch coefficients to be used by the filter, by changing the pitch coefficients;

a searcher structured to search for a pitch coefficient that makes a highest degree of similarity between the p-th estimated signal and a p-th sub-band out of the pitch coefficients, as a p-th optimal pitch coefficient; and a multiplexer structured to obtain the second encoded information by multiplexing P optimal pitch coefficients from a first optimal pitch coefficient to a P-th optimal pitch coefficient with the band division information, wherein:

the setter is configured to set pitch coefficients to be used by the filter to estimate a first sub-band, by changing the pitch coefficient within a predetermined range, and set pitch coefficients to be used by the filter to estimate an m-th (m=2, 3, . . . , P) sub-band at and after a second sub-band, by changing the pitch coefficient within a range corresponding to an (m−1)-th optimal pitch coefficient, or within a predetermined range.

3. The encoding apparatus according to claim 1, wherein the spectrum component selector is structured to select a spectrum component that is present in the region that has the predetermined threshold frequency band of a broader range for a sub-band in a higher frequency among the plurality of sub-bands.

4. A communication terminal device comprising the encoding apparatus according to claim 1.

5. A base station apparatus comprising the encoding apparatus according to claim 1.

6. The encoding apparatus according to claim 1, wherein the spectrum component selector selects a spectrum component that has an even-numbered sample index, the sample index being assigned to each spectrum component.

7. A decoding apparatus comprising:

a receiver structured to receive first encoded information obtained by encoding a lower frequency part of an input signal equal to or lower than a predetermined frequency generated by an encoding apparatus, and second encoded information generated by dividing a high frequency part of the input signal higher than the predetermined frequency into a plurality of sub-bands, estimating the plurality of sub-bands respectively from a first decoded signal obtained by decoding the first encoded information, selecting a spectrum component within each of the sub-bands, and calculating a second amplitude adjustment parameter for adjusting an amplitude for the selected spectrum component, the second amplitude adjustment parameter being a correlation value of the selected spectrum component and the input signal in a logarithmic domain;

a first decoder structured to generate a second decoded signal by decoding the first encoded information; and a second decoder structured to generate a third decoded signal by estimating a high frequency part of the input signal from the second decoded signal, wherein the second encoded information is generated by searching for a band which is most similar to a spectrum of each of the plurality of sub-bands and a first amplitude adjustment parameter from a spectrum of the decoded signal, searching for, for each of the sub-bands, a spectrum component having a maximum amplitude value for a spectrum of a high frequency that is estimated by the most similar band and the first amplitude adjustment parameter, selecting a spectrum component that is present in a region that has a wider bandwidth than a bandwidth of the spectrum component having the maximum amplitude value, the spectrum component having the maximum amplitude value being located at the center of the region, and calculating the second amplitude adjustment parameter that is the correlation value of the selected spectrum component and the input signal in a logarithmic domain, for the selected spectrum component.

8. The decoding apparatus according to claim 7, wherein the second decoder comprises:

an amplitude value searcher structured to search for, for each of the sub-bands, a spectrum component having a maximum amplitude value, for a band that is most similar to respective spectrums of the plurality of sub-bands calculated from the spectrum of the second decoded signal and for a spectrum of a high frequency that is estimated by a first amplitude adjustment parameter contained in the second encoded information;

a spectrum component selector structured to select a spectrum component that is present in a region that has a wider bandwidth than a bandwidth of the spectrum component having the maximum amplitude value, the spectrum component having the maximum amplitude value being located at the center of the region; and an amplitude adjustment parameter applier structured to apply the second amplitude adjustment parameter that is the correlation value of the selected spectrum component and the input signal in a logarithmic domain, for the selected spectrum component.

9. The decoding apparatus according to claim 8, wherein the amplitude value searcher structured to search for, for each of the sub-bands, a spectrum component having a maximum amplitude value, for a part of a spectrum component out of the spectrum of a high frequency that is estimated.

10. A communication terminal device comprising the decoding apparatus according to claim 7.

11. A base station apparatus comprising the decoding apparatus according to claim 7.

12. An encoding method comprising:

generating, by a processor, first encoded information by encoding a lower frequency part of an input signal equal to or lower than a predetermined frequency;

generating a decoded signal by decoding the first encoded information; and generating a second encoded information by dividing a high frequency part of the input signal higher than the predetermined frequency into a plurality of sub-bands, estimating the plurality of sub-bands respectively from the decoded signal, selecting a spectrum component within each of the sub-bands, and calculating a second amplitude adjustment parameter for adjusting an amplitude for the selected spectrum component, the second amplitude adjustment parameter being a correlation value of the selected spectrum component and the input signal in a logarithmic domain, wherein the generating of the second encoded information comprises:

searching for a band which is most similar to a spectrum of each of the plurality of sub-bands and a first amplitude adjustment parameter from a spectrum of the decoded signal;

searching for, for each of the sub-bands, a spectrum component having a maximum amplitude value for a spectrum of a high frequency that is estimated by the most similar band and the first amplitude adjustment parameter;

selecting a spectrum component that is present in a region that has a wider bandwidth than a bandwidth of the spectrum component having the maximum amplitude value, the spectrum component having the maximum amplitude value being located at the center of the region; and calculating the second amplitude adjustment parameter that is the correlation value of the selected spectrum component and the input signal in a logarithmic domain, for the selected spectrum component.

13. A decoding method comprising:

receiving, by a processor, first encoded information obtained by encoding a lower frequency part of an input signal equal to or lower than a predetermined frequency generated by an encoding apparatus, and second encoded information generated by dividing a high frequency part of the input signal higher than the predetermined frequency into a plurality of sub-bands, estimating the plurality of sub-bands respectively from a first decoded signal obtained by decoding the first encoded information, selecting a spectrum component within each of the sub-bands, and calculating a second amplitude adjustment parameter for adjusting an amplitude for the selected spectrum component, the second amplitude adjustment parameter being a correlation value of the selected spectrum component and the input signal in a logarithmic domain;

generating a second decoded signal by decoding the first encoded information; and generating a third decoded signal by estimating a high frequency part of the input signal from the second decoded signal, wherein the second encoded information is generated by searching for a band which is most similar to a spectrum of each of the plurality of sub-bands and a first amplitude adjustment parameter from a spectrum of the decoded signal, searching for, for each of the sub-bands, a spectrum component having a maximum amplitude value for a spectrum of a high frequency that is estimated by the most similar band and the first amplitude adjustment parameter, selecting a spectrum component that is present in a region that has a wider bandwidth than a bandwidth of the spectrum component having the maximum amplitude value the spectrum component having the maximum amplitude value being located at the center of the region, and calculating the second amplitude adjustment parameter that is the correlation value of the selected spectrum component and the input signal in a logarithmic domain, for the selected spectrum component.

* * * * *